United States Patent [19]

Biggs et al.

[11] Patent Number: 4,633,779

[45] Date of Patent: Jan. 6, 1987

[54] TIMING APPARATUS FOR A FUSE

[75] Inventors: Bradley M. Biggs, Tempe; Jimmy L. Brown, Mesa; Thomas M. Kerns, Tempe, all of Ariz.

[73] Assignee: Motorola, Inc., Schaumburg, Ill.

[21] Appl. No.: 626,562

[22] Filed: Jun. 29, 1984

[51] Int. Cl.[4] ..... F42C 11/06; F42C 15/40; F42C 21/00

[52] U.S. Cl. ..... 102/215; 102/206

[58] Field of Search ..... 102/215, 206

[56] References Cited

U.S. PATENT DOCUMENTS

| | | | |
|---|---|---|---|
| 3,500,746 | 3/1970 | Ambrosini | 102/215 |
| 3,622,987 | 11/1971 | Borkan | 102/215 |
| 3,646,371 | 2/1972 | Flad | 102/215 |
| 3,676,801 | 7/1972 | Musa | 331/116 R |
| 3,745,760 | 7/1973 | Keeler | 58/28 R |
| 3,760,732 | 9/1973 | Schuster et al. | 102/215 |
| 4,044,680 | 8/1977 | Ziemba | 102/215 |
| 4,217,826 | 8/1980 | Young, Jr. et al. | 102/215 |
| 4,240,350 | 12/1980 | Munzel et al. | 102/215 |
| 4,321,562 | 3/1982 | Igarashi | 331/116 FE |

*Primary Examiner*—Charles T. Jordan

*Attorney, Agent, or Firm*—Eugene A. Parsons

[57] ABSTRACT

An oscillator supplies clock pulses to a counter which also has a preselected time applied thereto and arming means are initiated when the count reaches the preselected time. Checking means are utilized throughout the circuitry to provide failsafe checking of each critical circuit with the arming circuit being deactivated if an error is detected. The entire circuit is incorporated in a single IC for energy and space conservation.

6 Claims, 20 Drawing Figures

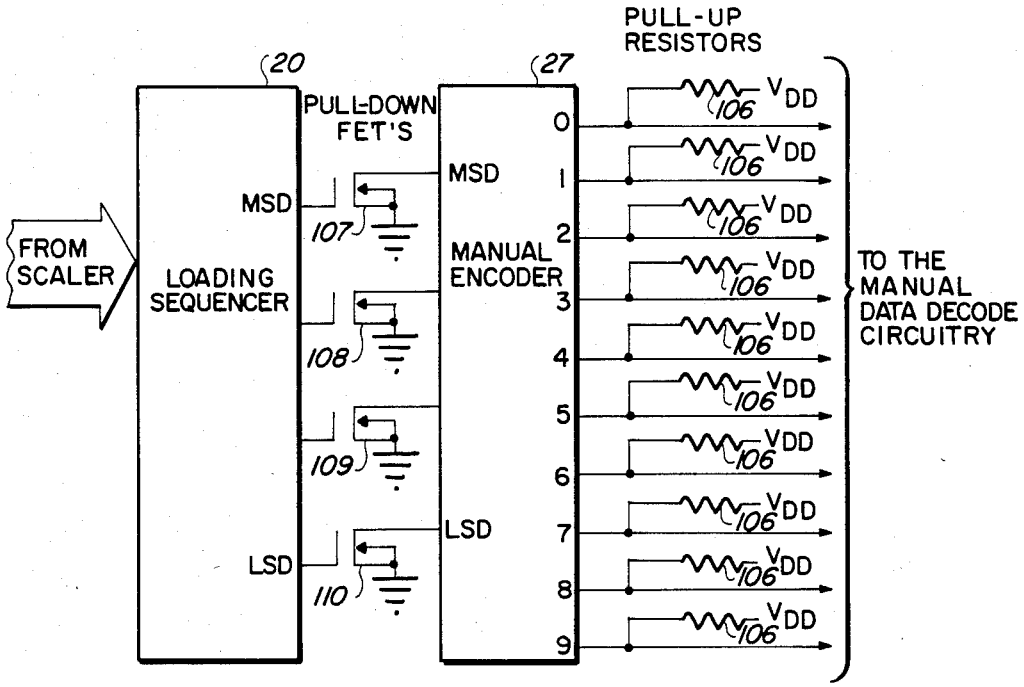
FIG. 6
FIG. 7
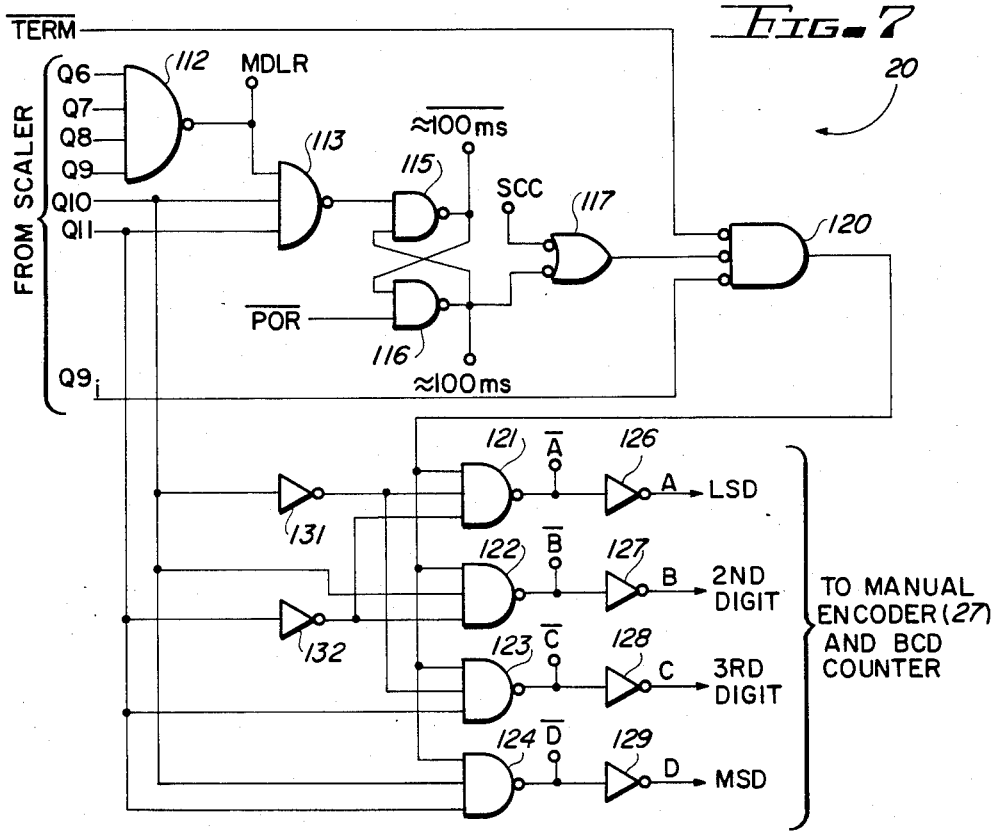

30
<100ms SAFETY CHECK
≥100ms SAFETY CHECK
TO GATE (42)
TO FIRE GATE
TO IMPACT SWITCH
IMPACT
IMPACT TO BCD COUNTER DECODE
210
213
215
223
225
45
IMPACT CNTR. (2-STAGE)
Q1
Q2
CL
220
214
212
211
221
218
207
208
217
205
206
LE2
LE3
CL ENABLE
≥10 RESET INH.
SCC
SCE
Q7
Q8
Q9
Q10
Q11
FROM THE SCALER (11)
LOADING SEQUENCER D
FROM THE MANUAL DATA DECODE
3RD BIT
2ND BIT
LOAD11
IMPACT BIT
LSB
POR

FROM FIG. 15A
RCVR DISABLE
SAFETY EN
DATA READY CHECK
REE / TERM
DATA READY
LOAD II
LOAD II
SAMPLE SAFETY CHECK
IMPACT BIT
POR
V DD
POR
POR
POR
≈100 MS
SCE
CL
D
R
Q
S
CL
CL
CL

TIMING APPARATUS FOR A FUSE

The invention herein may be manufactured and used by or for the Government of the United States of America for governmental purposes without the payment of any royalties.

BACKGROUND OF THE INVENTION

The present circuitry pertains to fuzes for use with projectiles and is especially concerned with timing of the fuze to prevent early detonation thereof. Early detonation of a fuze can be caused by a variety of failures of the fuze electronic timing circuit or through inadvertent human error in the setting of the desired time. In prior state of the art circuitry, redundant systems involving ANDing the outputs of two identical systems is utilized to check the operation of the circuitry. However, this design results in a large amount of circuitry to accommodate the complete duplication of all circuits. Further duplication of all circuits results in an excessive power drain. In projectiles of the type discussed herein, it is desirable to utilize power from a storage capacitor that is charged by a setback generator at firing. This capacitor's size is a function of power drain, making the capacitor very large for fuzes with much duplicated circuitry. The combined size of the duplicated circuitry and its excessively large storage capacitor would be prohibitive for projectile fuzing.

SUMMARY OF THE INVENTION

The present invention pertains to the timing apparatus for a projectile fuze. The timing apparatus includes an oscillator for providing clock pulses, data selecting means for providing an output indicative of a preselected time, a counter connected to receive the clock pulses and provide an output indicative of a preselected time, arming means coupled to the counter for arming the fuze after the preselected time is achieved, safety checking means coupled to the counter, and the arming means, data selecting means, and oscillator means for performing safety checks on all circuitry having the possibility of safety critical failures. The entire timing circuitry, along with the safety checking apparatus is incorporated in a single LSI capable of being operated by the fuze power system.

It is an object of the present invention to provide a new and improved timing apparatus for a projectile fuze.

It is a further object of the present invention to provide new and improved timing apparatus for a projectile fuze including safety checking circuitry for checking each circuit capable of safety critical failure.

It is a further object of the present invention to provide new and improved timing apparatus for a projectile fuze wherein the timing apparatus and safety checking circuitry is contained in a single LSI circuit.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures:

FIG. 6 is a schematic diagram of interphase circuitry used in conjunction with the manual encoder of FIG. 1;

FIG. 7 is a schematic diagram of a loading sequencer from FIG. 1;

DESCRIPTION OF THE PREFERRED EMBODIMENT

Figure 1:
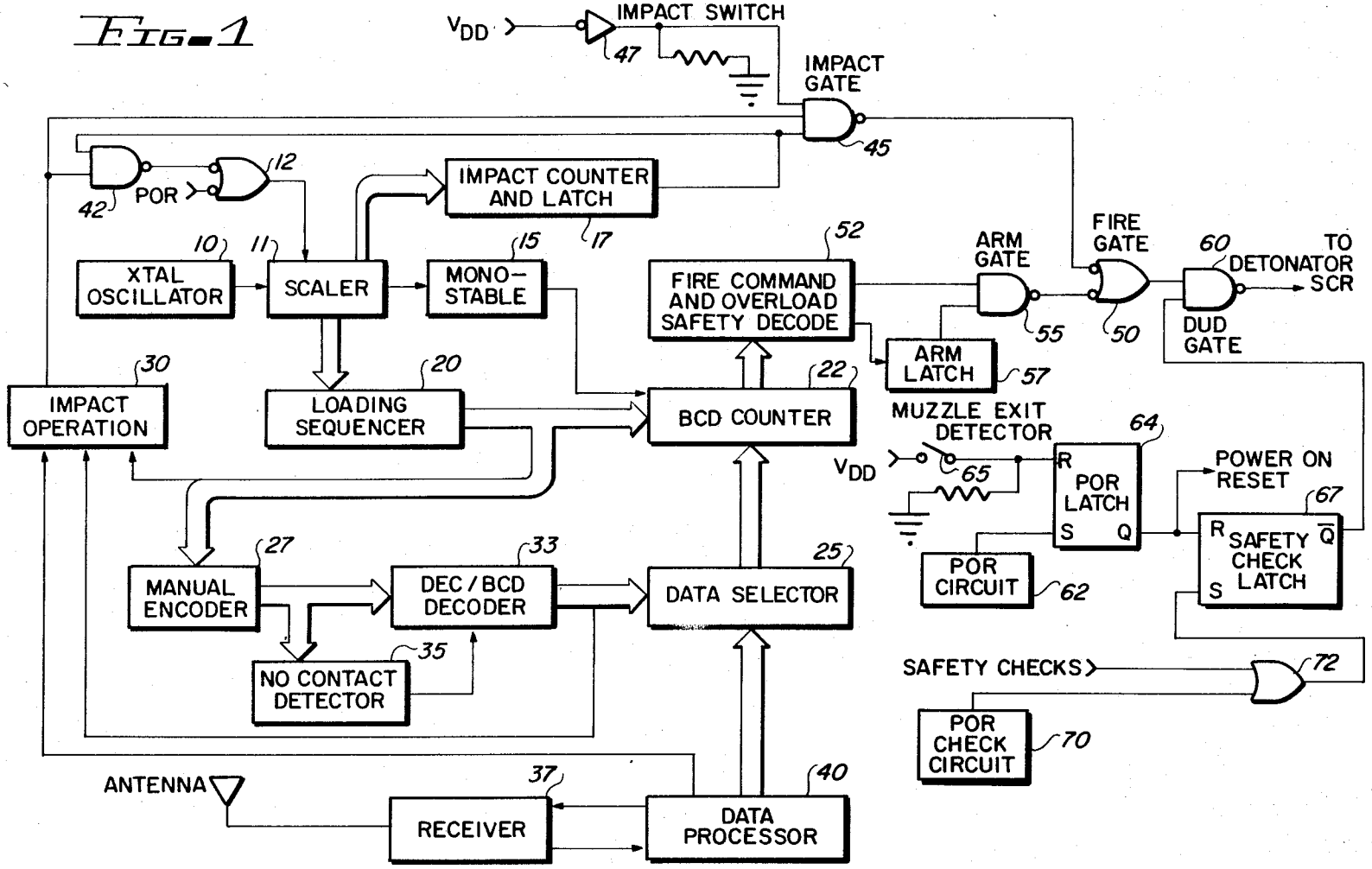
FIG. 1 is a block diagram of an LSI circuit containing timing apparatus and safety checking apparatus embodying the present invention.

Referring specifically to FIG. 1, a simplified block diagram of the timing and testing circuitry is illustrated. In general, the circuitry of FIG. 1 is included in a single LSI circuit designed to operate within the constraints of a projectile fuze power supply. As is well known in the art, the projectile fuze power supply may be a setback generator and capacitor, a battery activated by setback, etc. Because of the limited size of the fuze, the fuze power supply is relatively small. In the present circuitry, it is anticipated that the apparatus will operate for 200 seconds after firing. It will of course be understood that this is a matter of design choice and a different amount of time could be selected by those skilled in the art.

A crystal oscillator 10 provides clock pulses to a scaler circuit 11. The scaler circuit 11 also receives a signal from a NAND gate 12 and supplies signals to a monostable multivibrator 15, an impact counter and latch circuit 17, and a loading sequencer 20. The monostable multivibrator 15 supplies clock pulses to a BCD counter 22 which also receives signals from the loading sequencer 20 and from a data selector circuit 25. The loading sequencer 20 also sends signals to a manual encoder 27 and to an impact operation circuit 30. The manual encoder circuit 27 supplies signals directly to a decimal to BCD decoder 33 and through a no contact detector 35 to the decoder 33. The decoder 33 supplies signals to the data selector 25 and to the impact operation circuit 30. A receiver 37 receives signals by way of an antenna and exchanges data and control signals with a data processor 40 which also sends signals to the data selector 25 and the impact operation circuit 30. The impact operation circuit supplies a signal to a NAND gate 42 and to an impact gate 45. The impact gate 45 also receives signals from the impact counter and latch circuit 17 and from an impact switch 47 which is located externally of the LSI circuit. The output of the impact gate 45 is supplied to a fire gate 50. The BCD counter 22 supplies output signals to a fire command and overhead safety decode circuit 52 which supplies a signal directly to an arm gate 55 and through an arm latch 57 to arm gate 55. The arm gate 55 supplies a second signal to the fire gate 50. Fire gate 50 supplies a signal to a dud gate 60 the output of which is applied to the detonator SCR of the fuze. A power on reset (POR) circuit 62 supplies a set signal to a POR latch 64, which also receives a reset signal from a muzzle exit detector switch 65. The Q output of the POR latch 64 is supplied to reset a safety check latch circuit 67. A POR check circuit 70 provides one input of an OR gate 72, the other input of which is provided by various safety checks which will be described in more detail. The output of the OR gate 72 is supplied to the set input of the latch 67 without the Q output of latch 67 being supplied to the second input of dud gate 60. The internal circuitry of the various blocks illustrated in FIG. 1 and the overall operation of the apparatus will be described in conjunction with FIGS. 2 through 15. It should be noted that while negative logic (NOR and NAND gates) components are used in the preferred embodiment, the general "AND"ing and "OR"ing functions may be performed by any logic combinations convenient for the purposes.

Figure 2:
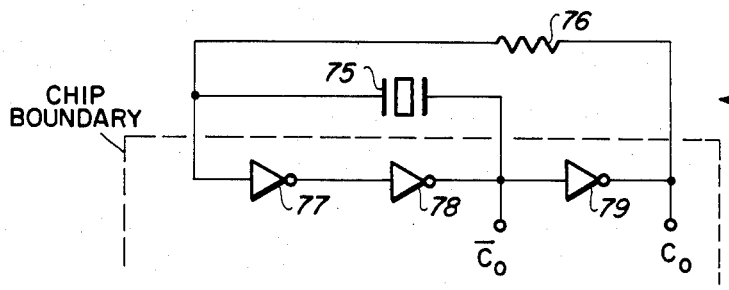
FIG. 2 is a more detailed block schematic diagram of a series configuration of a crystal oscillator illustrated in FIG. 1.

Referring specifically to FIG. 2, a schematic diagram of crystal oscillator 10 is illustrated. Crystal oscillator 10 includes a crystal 75, a resistor 76 and three inverters 77, 78 and 79. Inverters 77 through 79 are connected in series, without resistor 76 connected in parallel therewith. Crystal 75 is connected in parallel with inverters 77 and 78. A $\overline{C}_o$ C output is available between inverters 78 and 79 and a $C_o$ output is available between inverter 79 and resistor 76. A crystal oscillator is used in this embodiment to provide the required timing accuracy and a series configuration was chosen to achieve a fast, repeatable startup time. A startup time of 10 milliseconds (ms), or 10% of the total allowed error of 0.1 seconds, is achieved with the present configuration. For a 200 second fuze with a 0.1 second maximum time error over temperature, oscillator 10 must remain within ±0.05% of its nominal setting. This stringent requirement is most readily achieved with a crystal oscillator. The selected operating frequency of oscillator 10 is a tradeoff between minimum power dissipation and ruggedness of the quartz crystal for setback survivability. In general, low frequency is important for obtaining low current operation while small physical size is important for high G survival. A lower operating frequency decreases the current drain of the CMOS gates within inverters 77 through 79. However, a lower frequency requires a larger crystal element which is more susceptible to breakage in a high gravity unit (g) shock environment. As a further requirement, BCD counter 22 has a 0.1 second selectivity.

Figure 3:
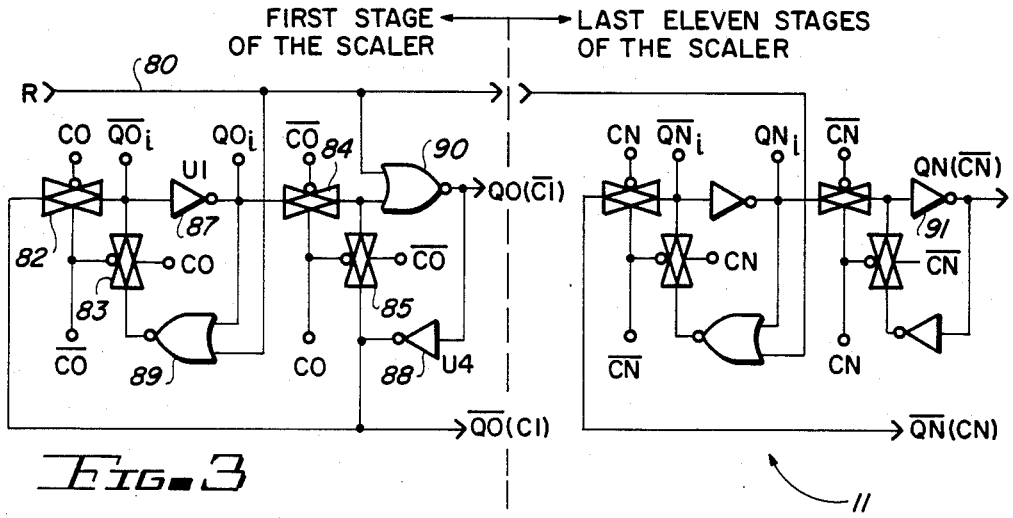
FIG. 3 is a schematic diagram, portions thereof removed, of a scaler illustrated in FIG. 1.

Scaler circuit 11 is a 12 stage binary counter which divides the output frequency of oscillator 10. A schematic diagram of the first stage and a representative of the last 11 stages is illustrated in FIG. 3. Scaler 11 is connected to receive a reset signal, R, on a reset line 80 (from gate 12) and 2 clock signals 180 degrees out of phase on lines designated Co and $\overline{Co}$. The C designation indicates a clock signal and the number following the C indicates the stage of the scaler from which the clock signal is obtained. The first stage of scaler 11 includes 4 transmission gates 82 through 85, 2 inverters 87 and 88, and 2 NOR gates 89 and 90. Each of the transmission gates 82 through 85 has an activating input, an inverter activating input, a signal input, and a signal output.

Figure 3A:
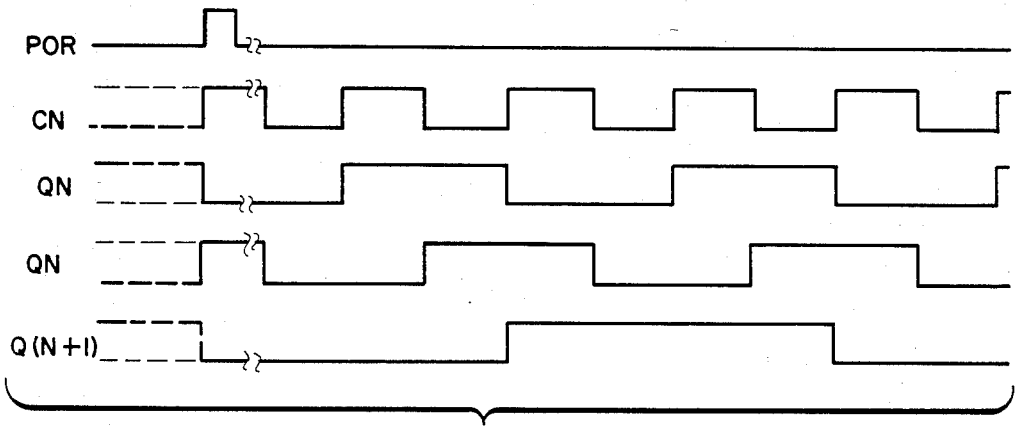
FIG. 3A illustrates a timing diagram for the scaler of FIG. 3.

The Co signal from oscillator 10 is applied to the inverted activating input of transmission gates 82 and 85 and to the activating inputs of transmission gates 83 and 84. The Co signal from oscillator 10 is applied to the activating inputs of transmission gates 82 and 85 and to the inverted activating input of transmission gates 83 and 84. The signal input of transmission gate 83 is received from the output of NOR gate 89. The signal output of transmission gate 83 and the signal output of transmission gate 82 are applied to the input of inverter 87. The signal output of transmission gate 82 is the $\overline{QO_i}$ output of the first counter stage. The reset signal on line 80 is applied to a first input of each of the NOR gates 89 and 90. The output of the inverter 87 appears at an output terminal $QO_i$, which will be explained presently, and is also applied to a second input of the NOR gate 89 and to the signal input of transmission gate 84. The signal output of transmission gate 84 is applied to a second input of NOR gate 90 along with the signal output of transmission gate 85. The output from NOR gate 90 is applied through inverter 88 to the signal inputs of transmission gates 85 and 82 and also appears as the $\overline{QO}$ output. The output of NOR gage 90 is also applied to the next stage as the $\overline{CI}$ input. A slight reduction in the required scaler circuitry is achieved by using the longer power on reset pulse width available from muzzle exit detector 65 (see FIG. 1) which closes upon muzzle exit of the projectile. Such a pulse width greatly exceeds the reset pulse width required for a worst case asynchronous reset of scaler 11. The reset is synchronous for the circuit illustrated in FIG. 3 because each stage of scaler 11 is reset sequentially from the first to the last stage. This is achieved using the internal gating of each stage, by permitting NOR gate 89 to reset the entire stage through transmission gates 83 and 84 when they are turned on with the clck output from the previous stage, and replacing NOR gate 90 with an inverter 91 in the last 11 stages. The operation of scaler 11 can be readily perceived from the timing diagram illustrated in FIG. 3A. Therefore, a complete description of the operation will not be set forth herein.

Figure 4:
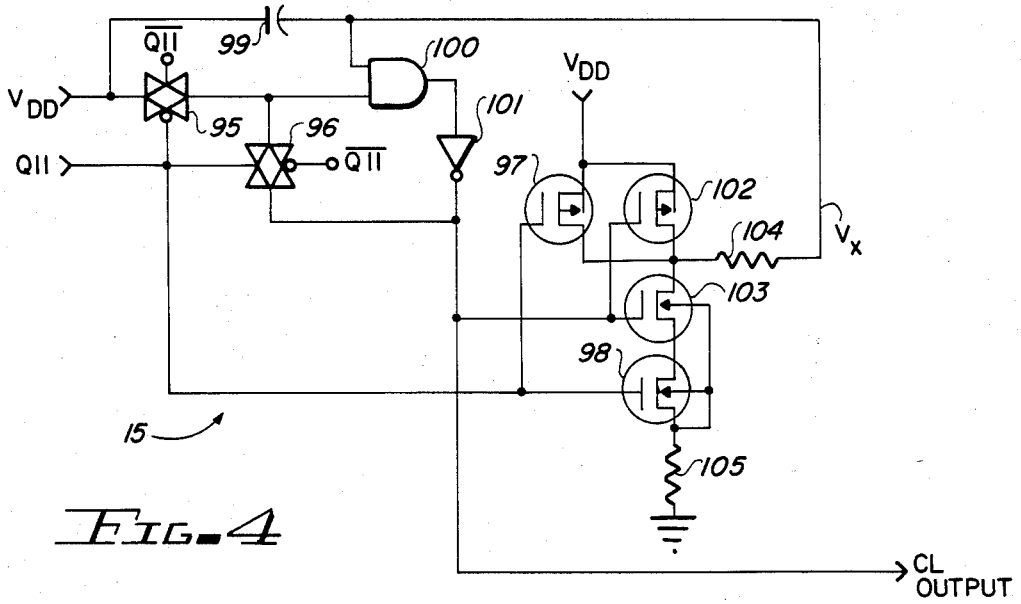
FIG. 4 is a schematic diagram of a monostable multivibrator illustrated in FIG. 1.

Referring to FIG. 4, monostable multivibrator 15 is illustrated schematically. Monostable multivibrator 15 includes a pair of transmission gates 95 and 96. Output Q11 from the final stage of scaler 11 is applied to the inverted activating input of transmission gate 95 and the activating input of transmission gate 96. The output Q11 from the final stage of scaler 11 is applied to the activating input of transmission gate 95 and the inverted activating input of transmission gate 96. The output Q11 is also applied to the gate terminal of a P channel field effect transistor 97 and an N channel field effect transistor 98. An input terminal, $V_{DD}$, adapted to have a positive voltage source attached thereto, is connected to the signal input of transmission gate 95 and to one terminal of a capacitor 99. The other terminal of capacitor 99 is connected to a first input of a NAND gate 100 and the signal outputs of transmission gates 95 and 96 are connected to a second input terminal of gate 100. The output of gate 100 is connected through an inverter 101 to the signal input of transmission gate 96, to the gate terminals of a P channel field effect transistor 102 and an N channel field effect transistor 103, and to an output terminal (CL) of multivibrator 15. Source terminals of transistors 97 and 102 are connected together and to the terminal $V_{DD}$. Drain terminals of the transistors 97 and 102 are connected together and to the drain terminal of transistor 103. The drain terminal of transistor 103 is also connected through a current limiting resistor 104 to capacitor 99 and first input of gate 100. The source terminal of transistor 103 is connected to the drain terminal of transistor 98. The source terminal of transistor 98 is connected through a resistor 105 to ground. The resistance value of resistor 105 is approximately 10 times that of resistor 104. Current limiting resistor 104 protects transistors 97 and 102 from excessive current when NAND gate 100 toggles high.

Figure 4A:
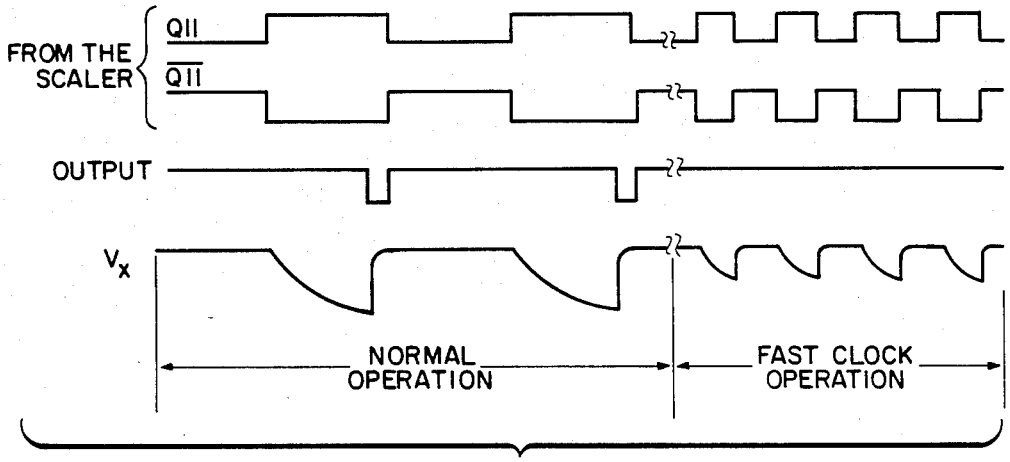
FIG. 4A illustrates a timing diagram for the multivibrator of FIG. 4.

Monostable multivibrator 15 is used to guard against early fuze functioning due to failure of oscillator 10 or scaler 11. At frequencies below the maximum operating rate of monostable 15, the output frequency will equal the output frequency of scaler 11. However, an oscillator 10 or scaler 11 circuit failure that produces a fast pulse condition cannot cause multivibrator 15 to operate above its cutoff frequency. This condition with an input monostable frequency in excess of 11 Hz (10 Hz +10%) will cause the output of multivibrator 15 to remain at a constant high level (as illustrated in the "fast clock operation " portion of FIG. 4A). Therefore, multivibrator 15 does not allow a scaler 11 clock frequency above 11 Hz to trigger BCD counter 22. This assists in keeping the fuze safe. A failure of multivibrator 15 will not result in an early function unless the oscillator 10 or scaler 11 has also experienced a component failure. The operation of multivibrator 15 will be clear to those skilled in the art from the timing diagram of FIG. 4A and, therefore, a complete description of the operation is not included herein.

The present embodiment of the fuze timing apparatus has both auto set and hand set backup capability. The handset provides an alternate means for setting the timing in case of a disabled auto set link and allows the fuze to be used in weapons not having auto set capability. The hand set is provided by mechanical storage and electrical sampling of the programmed time set. A mechanical encoder mechanically stores the programmed set time and visually displays this time for programming and verification of the fuze status. Typical manual encoders which mauy be utilized for this application are disclosed in copending U.S. patent application Ser. No. 534,872, filed Sept. 22, 1983, entitled "Fast Indexing Encoder Apparatus", and assigned to the same assignee; Ser. No. 534,959, filed Sept. 22, 1983, entitled "Fast Indexing Encoder Apparatus", and assigned to the same assignee; and Ser. No. 534,994, filed Sept. 22, 1982, entitled "Fast Indexing Encoder Apparatus", and assigned to the same assignee.

Figure 5:
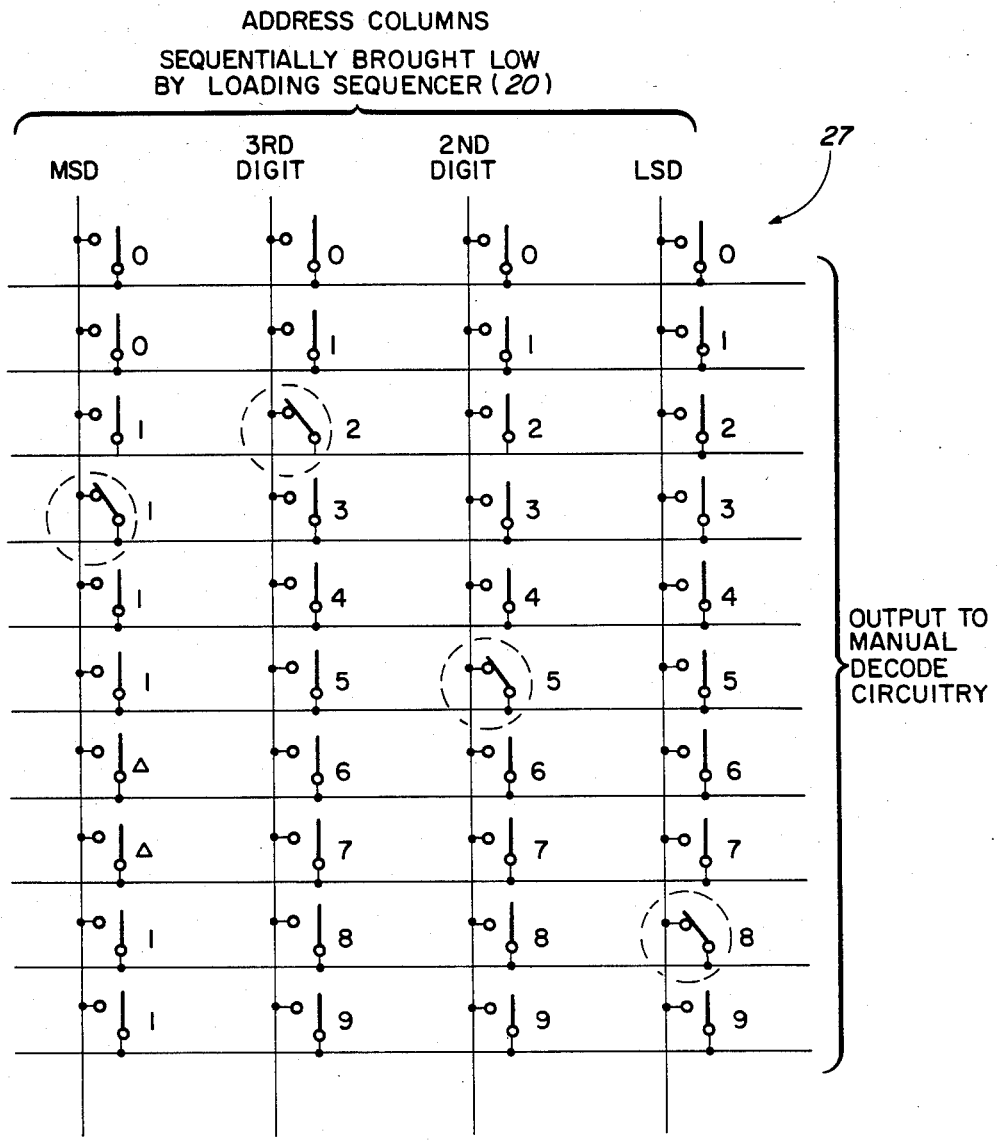
FIG. 5 is a schematic diagram of a manual encoder where interconnections are illustrated in FIG. 1.

A representative circuit for the manual encoder is illustrated in FIG. 5. The manual encoder mechanically stores the hand selected set time. It is a multiplexed, four digit, one of ten line encoder that provides two thousand possible settings from 000.0 to 199.9 seconds. The most significant digit (MSD) permits selection of impact operation for the fuze as well as selection of the most significant time digit. Manual programming for impact operation requires that encoder 27 be set at Δ99.9, where Δ signifies an impact operation. The 99.9 encoder setting in addition to the Δ symbol is used in consideration of the fuze's overhead safety requirement. In the representative illustration of manual encoder 27, a dashed circle around a switch highlights the closed switches and the example shown in FIG. 5 corresponds to a stored set time of 125.8 seconds.

Electrical sampling of the manual encoder is provided by special interface circuitry illustrated in FIG. 6. Each of the 10 rows in the representative circuit of FIG. 5 is connected through a resistor 106 to the positive voltage terminal $V_{DD}$, as illustrated in FIG. 6. Data is programmed by sequentially connecting each digit column to ground through N channel field effect transistors 107 through 110, respectively. The gates of each of the transistors 107 through 110 are connected to outputs of the loading sequencer 20. The special interface circuitry of FIG. 6 is required to interface with the manual encoder 27 due to the encoder's hard wired, common connections to each output line. The special interface circuitry prevents the CMOS gating in the loading sequencer 20, which drives the address lines, from being short circuited by the manual encoder 27. For example, referring to FIG. 5 such a short circuit could occur if the programmed time of 122.8 seconds were selected. In this case the third digit address line would be shorted to the second digit address line via the switches connecting them to the common "2" output line. If the address lines were driven with the outputs of standard CMOS gates, the short could result in a very low impedance from positive power terminal $V_{DD}$ to ground when either of the digits is addressed (taken to a "low") while the other digit remains at its normal high level. The special interface circuitry utilizes pulldown field effect transistors 107 through 110 and the 10 pull up resistors 106. Transistors 107 through 110 sequentially drive the four address lines to manual encoder 27 and resistors 106 maintain the nonselected encoder outputs at a logic high state. With this circuit, a connection between the second and third digits (or any other digits) has no detrimental effect because $V_{DD}$ is now isolated from ground by pull up resistors 106.

Figure 14:
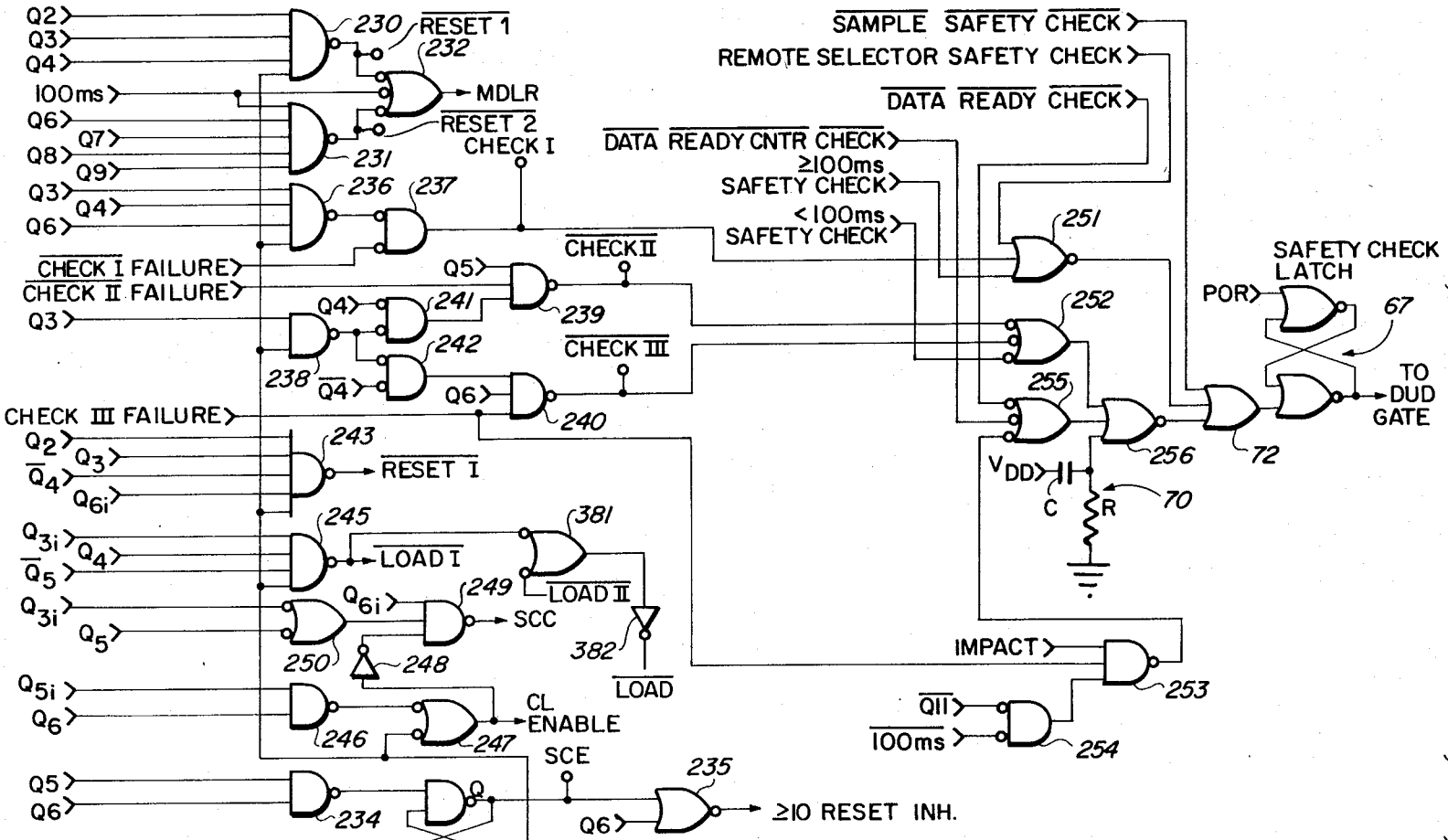
FIG. 14 is a schematic diagram of the BCD counter safety check circuitry from FIG. 1.
Figure 15A:
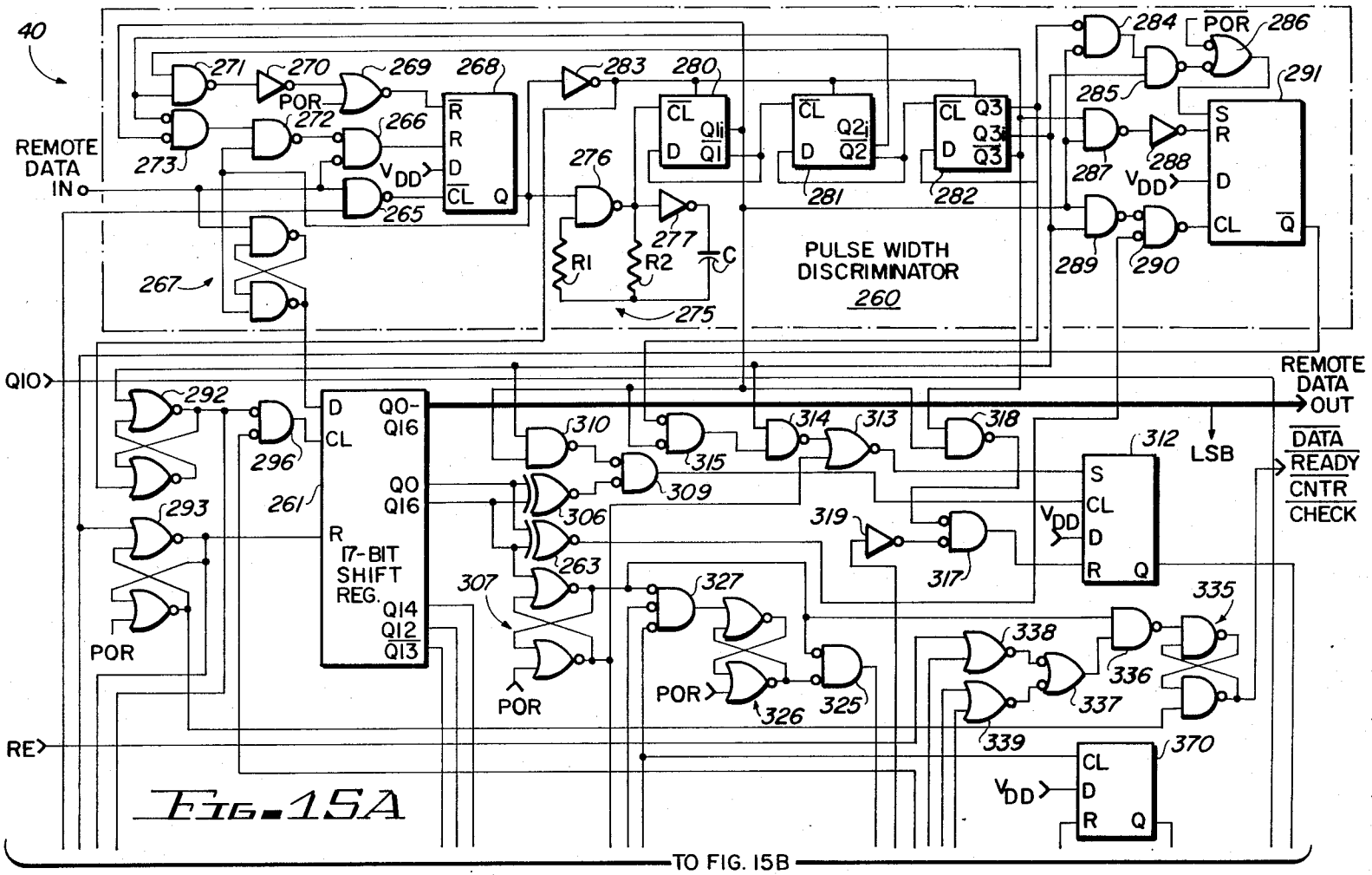
FIGS. 15A and 15B are a schematic diagram of the data processor from FIG. 1.
Figure 15B:
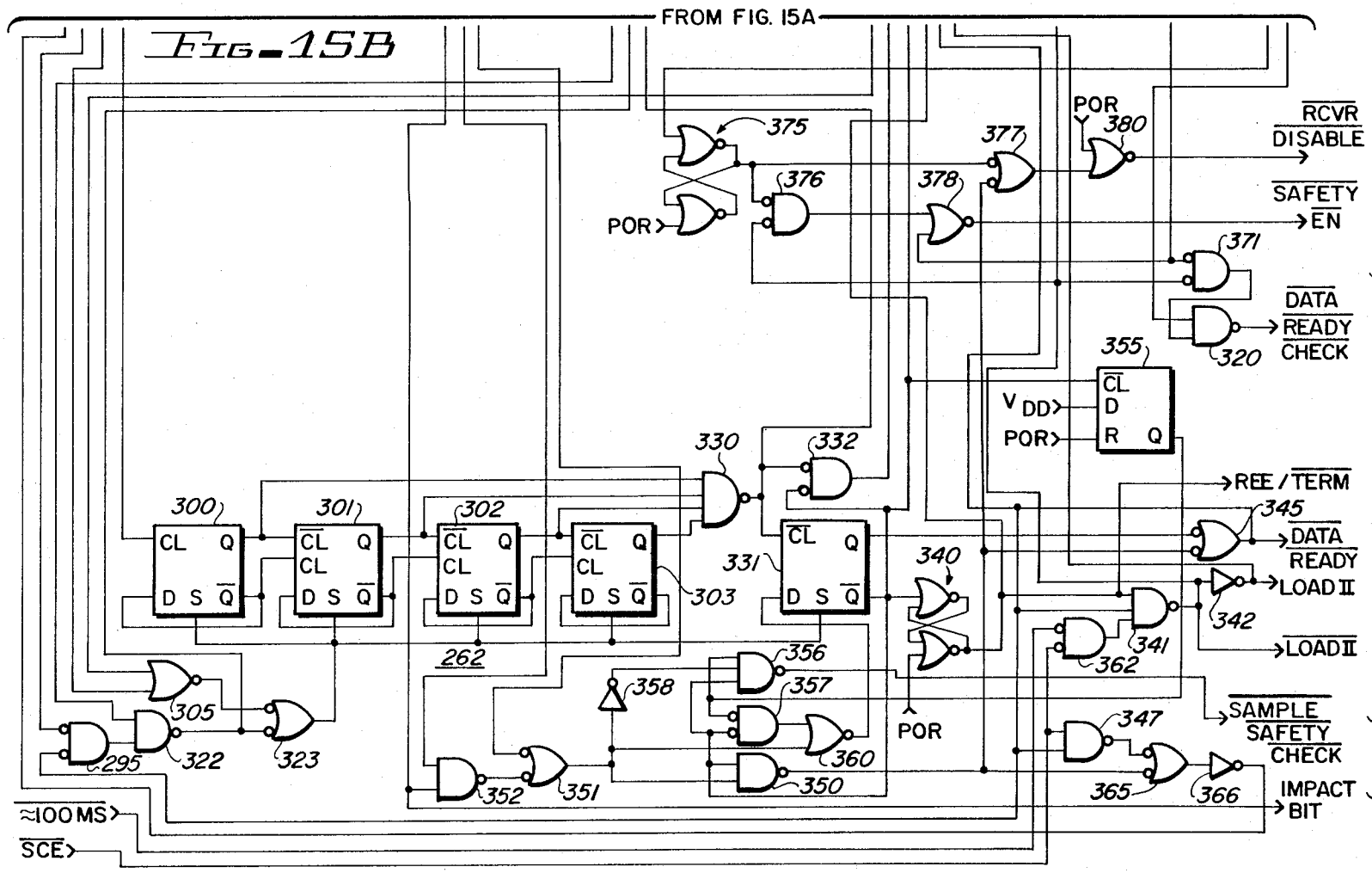

Loading sequencer 20, the outputs of which are connected to the gates of transistors 107 through 110 is illustrated schematically in FIG. 7. Sequencer 20 includes a NAND gate 112 having 4 inputs connected to outputs Q6 through Q9 of scaler 11. A NAND gate 113 is connected to receive the output of NAND gate 112 and outputs Q10 and Q11 from scaler 11 on 3 inputs thereof. A manual data latch reset (MDLR) signal is applied to an input connected to the same input of NAND gate 113 as the output of NAND gate 112. A pair of NAND gates 115 and 116 are interconnected in a flip flop orientation with a first input connected to the output of NAND gate 113 and a second input connected to receive an inverted power on reset ($\overline{POR}$) signal. The output from the flip flop is applied to a first input of a NAND gate 117. The output from gate 116 is also the ≈100ms signal applied to other portions of the circuit (FIG. 14) and the output from gate 115 is the $\overline{\approx 100ms}$ signal applied to other portions of the circuit (FIG. 15). A second input of gate 117 is a safety check clock (SCC) signal obtained from the safety check circuitry of FIG. 14 to be explained presently. The output of gate 117 is the $\overline{SCC}$ signal and is applied to a first input of a NOR gate 120. A second input of gate 120 is a $\overline{TERM}$ output from the data processor 40, illustrated in FIG. 15. A third input to gate 120 is the $Q9_i$ output from stage 10 of scaler 11. The output of gate 120 is applied to a first input of each of 4 NAND gates 121 through 124. Gate 121 supplies a control signal $\overline{A}$ to stage 1 of BCD counter 22 and through an inverter 126 to the pull down field effect transistor 110 (see FIG. 6) for sampling the least significant digit (LSD) in the manual encoder 27. Similarly gate 122 supplies a control signal $\overline{B}$ to stage 2 of BCD counter 22 and through an inverter 127 to control the second digit of manual encoder 27, gate 123 supplies a control signal $\overline{C}$ to stage 3 of BCD counter 22 and through an inverter 128 to control the third digit of manual encoder 27 and gate 124 supplies a control signal $\overline{D}$ to stage 4 of BCD counter 22 and through an inverter 129 to control the most significant digit (MSD) of the manual encoder 27. The gate 121 receives second and third inputs from inverters 131 and 132, which receive inputs from outputs Q10 and Q11, respectively, from scaler 11. Gate 122 receives a second input directly from output Q10 of scaler 11 and a third input from inverter 132. Gate 123 receives a second input from inverter 131 and a third input directly from output Q11 of scaler 11. Gate 124 receives second and third inputs directly from outputs Q10 and Q11, respectively, of scaler 11.

Figure 8:
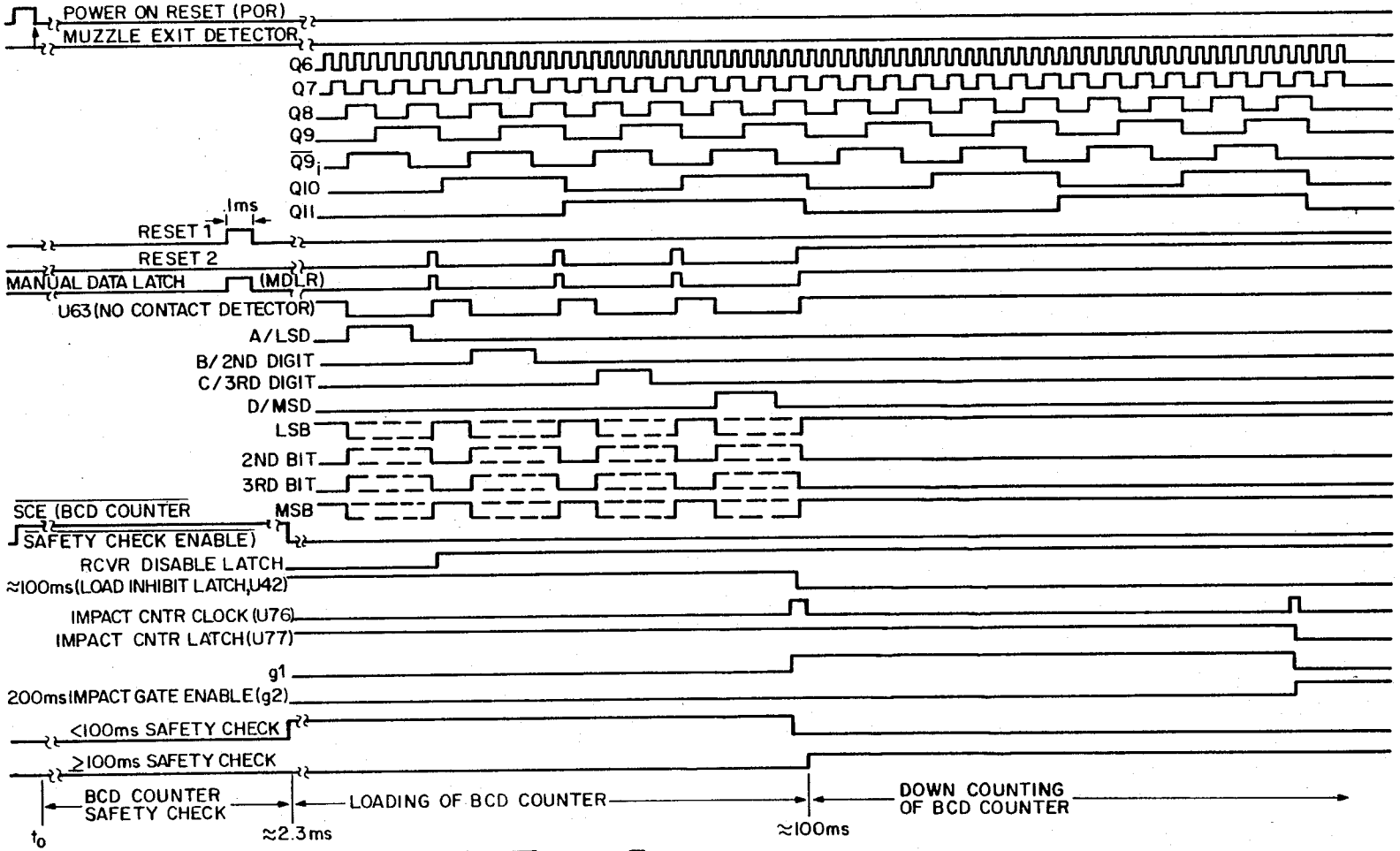
FIG. 8 illustrates a timing diagram for the loading sequencer of FIG. 7.

Referring to FIG. 8, a timing diagram is illustrated which shows specific waveforms for three different periods of operation: the BCD counter safety check; loading of the BCD counter; and down counting of the BCD counter. The loading sequencer 20 of FIG. 7 operates during the period of time labeled "loading of BCD counter", which occurs from approximately 2.3 ms after setback until 100 ms after setback. One skilled in the art can determine the complete operation of the sequencer of FIG. 7 from the timing chart of FIG. 8 but a short overview follows.

The $\overline{TERM}$ signal in FIG. 7 is low during the "loading of BCD" counter period of time. The safety check clock (SCC) signal in FIG. 7 is used during the safety check sequence, described presently, but is high during the "loading of BCD counter" period and does not effect normal operation of the loading sequencer 20. The $\overline{POR}$ signal is the opposite of the POR signal illustrated in FIG. 8 and, therefore, is high during the period of interest. Since signals Q6 through Q11 are alternating at regular intervals, the output of gate 117 will be low during the period of interest. Thus, the output of gate 120 will normally be low but will go high during the times that the signal $Q9_i$ goes low. The $Q9_i$ signal essentially controls the gates 121 through 124. Referring to FIG. 8 it will be seen that the signal $Q9_i$ goes low 4 times during the loading of BCD counter 22. Thus, the times during which the gates 121 through 124 receive a high output from gate 120 are: 6.25 ms to 18.75 ms; 31.25 ms to 43.75 ms; 56.25 ms to 68.75 ms; and 81.25 ms to 93.75 ms.

Referring to FIG. 8 it can be seen that both of the signals Q10 and Q11 are low during the time 6.25 ms to 18.75 ms. Thus, the inverters 131 and 132 supply high signals to the gate 121 and a low signal is provided at the output thereof. This low signal is inverted and applied to the gate of transistor 110 to sample the LSD column of switches in the manual encoder 27. In the example illustrated in FIG. 5, the eighth line will be pulled down by the transistor 110 from 6.25 ms to 18.75 ms. Referring again to FIG. 8 it can be seen that output Q10 is high and output Q11 is low during the 31.25 ms to 43.75 ms interval. Inverter 132 will invert output Q11 so that all of the inputs of gate 122 are high during this interval and, consequently, a high signal will be applied to the gate of transistor 109 pulling down the second digit column of the manual encoder 127 and causing line 5 of the output to be low during this interval. During the 56.25 ms to 68.75 ms interval, output Q10 is low and output Q11 is high. Inverter 131 inverts output Q10 so that all of the inputs to gate 123 are high and a high signal is applied to the gate of transistor 108 to pull down the third digit column of manual encoder 27 so that the number 2 output line is low during this interval of time. During the 81.25 ms to 93.75 ms interval both outputs Q10 and Q11 are high so that all of the inputs to gate 124 are high and a high signal is applied to the gate of transistor 107. Transistor 107 pulls the MSD column low and the number 3 output line (designated 1 in the MSD column) is low for this interval of time. Thus, each of the 4 columns in manual encoder 27 is sampled separately during the 4 intervals of time. Since the MSD column of encoder 27 contains the impact set information, the delayed sampling (81.25 ms to 93.75 ms) of the MSD column permits reception of the auto set word prior to the setting of the impact latch by way of the hand set information. As will be understood presently, this specific timing reduces the circuitry required for setting the time or impact modes of operation.

Figure 9:
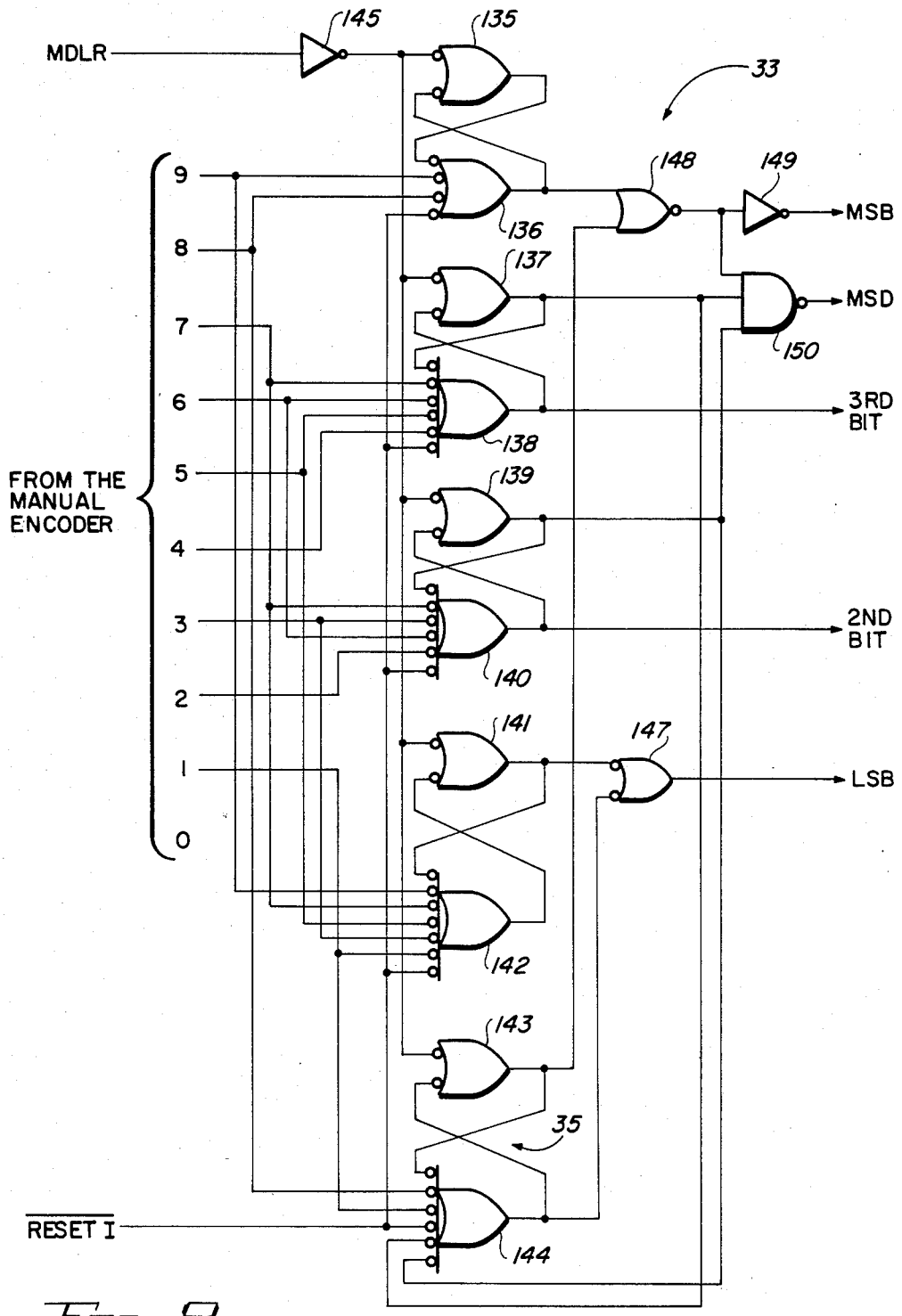
FIG. 9 is a schematic diagram of manual decode circuitry included in the decimal to BCD (binary coded decimal) decoder of FIG. 1.

Decimal to BCD decoder 33 is illustrated schematically in FIG. 9. Decoder 33 includes 10 NAND gates 135 through 144 interconnected in pairs to form 5 flip flop circuits. An MDLR input is supplied through an inverter 145 to an input of each of the gates 135, 137, 139, 141, and 143, which gates form first portions of each of the five flip flops. A $\overline{RESET\ I}$ signal is supplied to inputs of gates 136, 138, 140, 142, and 144, which gates form second portions of each of the five flip flops. As seen from FIG. 8, the $\overline{RESET\ I}$ signal is positive throughout the intervals during which encoder 27 is sampled. Also, by referring to FIG. 8 it can be seen that the MDLR signal is low during the sampling intervals and goes high for a short period between each of the sampled intervals. The 10 lines, 0 through 9, from encoder 27 are connected to inputs of gates 136, 138, 140, 142, and 144 to cause the flip flops to operate so as to convert the decimal input to a BCD output. The outputs of gates 141 and 144 are applied to 2 inputs a NAND gate 147, the output of which represents the least significant bit of the BCD output. The output of gate 140 represents the second bit. The output of gate 138 represents the third bit. The output of gates 136 and 143 are supplied to 2 inputs of a NOR gate 148, the output of which is supplied through an inverter 149 as the most significant bit of the BCD output. The outputs of gates 137, 139, and 148 are supplied to 3 inputs of a NAND gate 150, the output of which is an indication of the most significant digit selected in manual encoder 27.

In addition to decoding the decimal input, decoder 33 is designed to safeguard against no output and multiple outputs from manual encoder 27 and to identify erroneous settings of the MSD in manual encoder 27. The safeguards are accomplished by the inherent "OR"ing of decoder 33 and the addition of no contact detector 35. Gates 143 and 144 are referred to herein as no contact detector 35 because it protects against an early function of the fuze caused by the absence of an output from manual encoder 27. This fault can result from an encoder switch not making a satisfactory electrical connection or a failure in special interface circuitry (FIG. 6). A failure in sequencer 20 can also cause this type of fault but the present system is protected against a sequencer failure by preloading the BCD counter with the maximum time (199.9 seconds) during the BCD counter safety check (first time period in FIG. 8). As illustrated in FIG. 8, the MDLR signal includes a positive pulse prior to the loading of BCD counter time period. The MDLR also includes a positive pulse between each encoder sampling time interval. Further, as explained in conjunction with FIGS. 5 and 6, any time the encoder 27 is not being sampled or any time an unsatisfactory electrical contact is made in one of the switches, the 10 inputs to decoder 33 are all positive. Referring specifically to FIG. 9, it can be seen that a positive MDLR signal and all positive signals on the inputs from encoder 27 result in a BCD reading of 9 on the 4 bit output. By maintaining the output of decoder 37 at a 9 until an output is received from manual encoder 27, the no contact detector 35 and enable gates 147 and 148 protect the fuze against the absence of an output from manual encoder 27.

The "OR"ing function of decoder 33 protects the fuze against multiple outputs from manual encoder 27 by inherently providing a time setting to BCD counter 22 which is greater than or equal to the selected hand set time. This action makes the fuze design fail safe by preventing BCD counter 22 from being loaded with a shorter time than that which was programmed into manual encoder 27. Multiple outputs can result from a short circuit between the outputs of manual encoder 27, a failure in loading sequencer 20, or a failure in the special interface circuitry (FIG. 6). However, when multiple outputs are applied to decoder 33 the longest time will be selected because each bit of the BCD output is set at 9 initially.

Decoder 33 also outputs special data for safety checking the timer logic within the system. This data is programmed into decoder 33 via the BCD counter safety check logic (to be explained presently). The special data is an "F" in hexidecimal and "9" which corresponds to 1111 and 1001 in binary code. The "F" output is programmed into decoder 33 with the $\overline{\text{RESET I}}$ signal and the "F" is subsequently loaded into the BCD counter 22 in order to verify that every output from BCD counter 22 can be set with hand set data from manual encoder 27. This reset condition does not need verification because its failure will not result in a decrease in the time programmed into BCD counter 22. The "9" output from decoder 33 for each of the 4 decimal inputs is used to initialize BCD counter 22 output to 199.9 prior to loading any data from manual encoder 27 into BCD counter 22. This preload safeguards the fuze against a missing output from sequencer 20.

Figure 10:
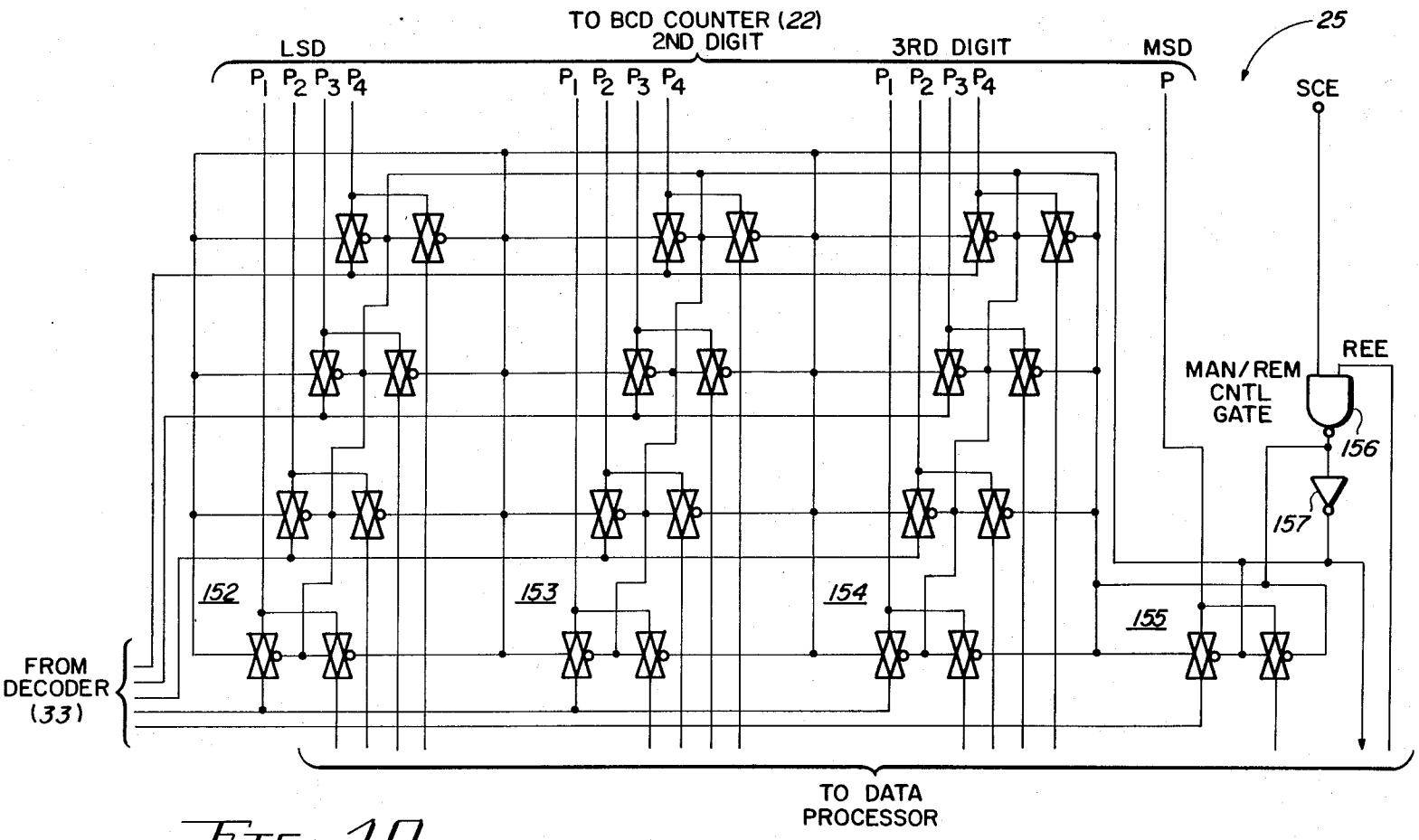
FIG. 10 is a schematic diagram of a data selector and manual/remote control gate from FIG. 1.

FIG. 10 schematically illustrates data selector 25. In the present embodiment data selector 25 includes 26 transmission gates which are divided into a first group of 8 designated 152, a second group of 8 designated 153, a third group of 8 designated 154 and the remaining pair designated 155. Transmission gates were used in selector 25 as an alternative to a more complex NAND configuration because the transmission gates reduce the area required in the custom LSI chip by lowering the component count from 158 transistors that make up 39 dual input NAND gates and one inverter to 54 transistors that make up 26 transmission gates and one inverter.

A manual/remote control gate includes a NAND gate 156 and an inverter 157. Control gate 156 receives a first input, a safety check enable (SCE) signal, from the BCD counter safety check circuitry (FIG. 14) and a remote data enable (REE) signal from the data processor (FIG. 15). The output of control gate 156 is applied directly to 1 activating input of each of the 26 transmission gates and through inverter 157 to the opposite activating input of each of the 26 transmission gates. The SCE signal overrides the REE signal in control gate 156 to make BCD counter 22 accept only data from manual encoder 27 during the first 6.25 ms after setback, as required for the BCD counter safety check. After this time delay the output of control gate 156 is determined by the REE signal, which toggles high after receiving a valid word of auto set data from data processor 40. Since the fuze provides both auto set and hand set (or manual) capabilities and since the hand set is utilized only as an alternate means for setting the fuze in case of a disabled set link or in weapons not having auto set capability, the REE signal into the control gate 156 switches all 26 transmission gates so that data on the 13 data lines from the data processor 40 are connected to the 13 data lines of BCD counter 22. As illustrated in FIG. 10, the first 4 lines carry a BCD representation of the least significant digit, the next 4 lines carry a BCD represention of the second digit, the next 4 lines carry a BCD representation of the third digit and the last line carries an indication of the most significant digit. If no REE signal is received by control gate 156, the 26 transmission gates connect the 5 lines from decoder 33 to the 13 lines of BCD counter 22. The 4 lines representing the least significant bit (LSB), the second bit, the third bit, and the most significant bit (MSB) are connected to each of the four lines of the BCD counter 22 representing the least significant digit, the second digit, and the third digit. The fifth line of decoder 33, providing an indication of the most significant digit, is connected to one of the pair of transmission gates 155 which connects it to the thirteenth line of BCD counter 22. Since the 4 digits are represented sequentially on the 4 lines from decoder 33, with the least significant bit being represented first, the BCD counter 22 must also be toggled with the 4 output signals from loading sequencer 20. The signals from sequencer 20 toggle the BCD counter 22 so that each BCD representation is placed in the correct stage of the counter, as will become apparent presently.

Figure 11:
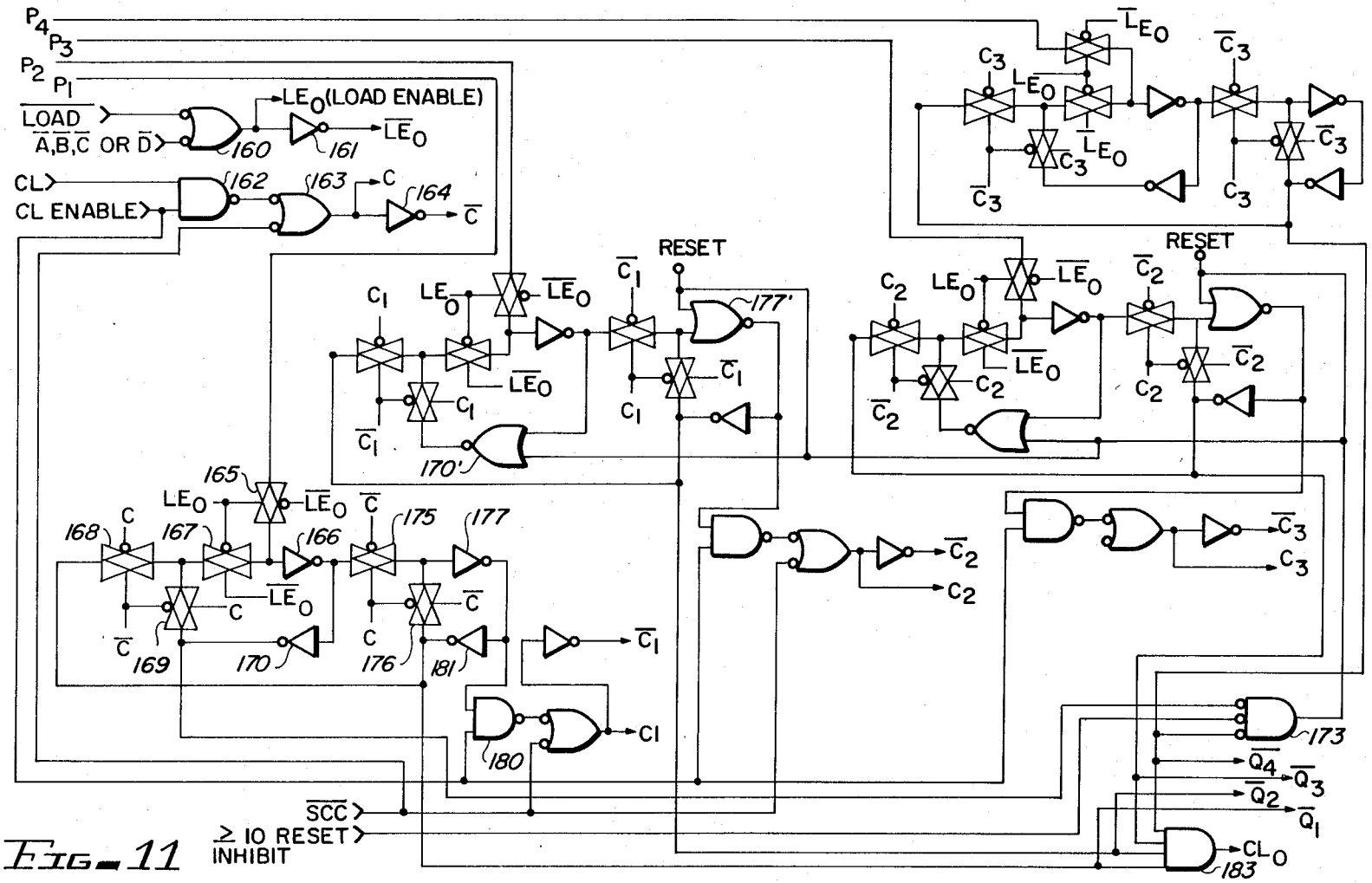
FIG. 11 is a schematic diagram of a BCD counter from FIG. 1.

BCD counter 22 stores the preset code and counts down the selected set time. It is a presettable counter with both synchronous and asynchronous clocking. The dual clocking permits BCD counter 22 to provide the optimum in safety and reliability. A schematic diagram of a single stage of the BCD counter is illustrated in FIG. 11. The counter consists of 4 stages: the least significant digit; the second digit; the third digit; and the most significant digit. The first 3 stages are all similar to the stage illustrated in FIG. 11, with each stage including 4 flip flops, and the final stage contains a single flip flop. Only 1 stage is illustrated in FIG. 11 for simplicity of description and illustration.

A first NAND gate 160 is connected to receive 2 inputs; a $\overline{\text{LOAD}}$ signal received from the BCD counter safety check circuitry (FIG. 14) and the appropriate output ($\overline{A}$, $\overline{B}$, $\overline{C}$, or $\overline{D}$) from loading sequencer 20. As will be apparent to those skilled in the art, the first stage of BCD counter 22 receives the $\overline{A}$ signal from sequencer 20, the second stage receives the $\overline{B}$ signal from sequencer 20, the third stage receives the $\overline{C}$ signal from sequencer 20, and the fourth stage receives the $\overline{D}$ signal. The output of gate 160 is applied directly to the remainder of the stage as a load enable (LE) signal and is also supplied through an inverter 161 to the remainder of the circuitry as an inverted load enable signal ($\overline{LE}$).

A NAND gate 162 is connected to receive a second pair of inputs to BCD counter 22. A first input of gate 162 is connected directly to the output of monostable multivibrator 15 to receive the clocking (CL) signal therefrom. A second input of gate 162 is connected to receive a clock enable (CL ENABLE) signal from the BCD counter safety ch4eck circuitry (FIG. 14). The output of gate 162 is supplied to one input of a NAND gate 163. A second input of gate 163 is connected to receive an inverted safety check clock ($\overline{SCC}$) signal from the BCD counter safety check circuit (FIG. 14). The output of gate 163 is applied directly to transmission gates of the first flip flop as an activation signal (C) and is applied through an inverter 164 to the transmission gates of the first flip flop as an activation signal ($\overline{C}$).

Four input signals $P_1$ through $P_4$ are received from the appropriate set of 4 outputs from data selector 25 (FIG. 10). The first input signal, $P_1$, is supplied to a signal input of a transmission gate 165. The activation input of transmission gate 165 is connected to receive signal LE and the inverted activation input is connected to receive the signal $\overline{LE}$. The output signal from transmission gate 165 is applied to an inverter 166 along with the signal output of a transission gate 167. The signal input of transmission gate 167 is connected to signal outputs of 2 transmission gates 168 and 169. The C activating signal is applied to the inverted activating input of gate 168 and the activating input of gate 169. The $\overline{C}$ signal is applied to the activating input of gate 168 and the inverted activating input of gate 169. The signal input of gate 169 is connected to the output of an inverter 170, the input of which is connected to the output of inverter 166. The output of inverter 170 is also connected to a first input of a NOR gate 173. The output of inverter 166 is connected to the signal input of a transmission gate 175. The signal output of gate 175 is connected to the signal output of a transmission gate 176 and to the input of an inverter 177. The activating and deactivating inputs of transmission gates 175 and 176, respectively are connected to receive the C signal while the deactivating and activating inputs of transmission gates 175 and 176, respectively, are connected to receive the $\overline{C}$ signals. The output of inverter 177 is connected to a first input of a NAND gate 180 and through an inverter 181 to the signal inputs of transmission gates 168 and 176. The output of inverter 181 is also connected to a $\overline{Q}_1$ output terminal of the counter stage and to a first input of a NAND gate 183. The gate 180 is the clocking input gate, similar to gate 162, for the second flip flop of the illustrated counter stage.

The three remaining flip flops are basically similar to the first flip flop and, therefore, a detailed description of the connections thereof will not be provided. The second and third flip flops of the illustrated counter stage differ from the first flip flop in that two NOR gates 170′ and 177′ are substituted for inverters 170 and 177. One input and the output of gate 170′ is connected the same as inverter 170 and a second input of gate 170′ is connected to an output of gate 173 and to an input terminal adapted to have a reset signal supplied thereto. One input and the output of gate 177′ is connected the same as inverter 177 and a second input is connected to the second input of gate 170′. Gate 173 has a second input connected to receive ≧RESET INH signal. Also, gate 173 has a third input connected to receive the Q4 output signal from the final flip flop. Gates 170′ and 177′ allow the second and third flip flops of the first, second, and third stages of BCD counter 22 to be reset, allowing the first, second, and third stages of BCD counter 22 to be rolled over from "0" to "9" when BCD counter 22 is counting down the selected set time. Within the initial 10 ms after fuze operation, the ≧RESET INH signal is applied to gate 173 so the flip flops will not be reset by 170′ and 177′ during the BCD counter safety check. Gate 183 is connected to receive the output from each of the 4 flip flops and supplies a CLo signal to the input gate (gate 162) of the next counter stage.

The synchronous clock of BCD counter 22 permits an operational check of the counter divide by two operation. This operation is verified during the safety check of BCD counter 22 by tying CL ENABLE low and ≧10 RESET INH high. Subsequently, the $\overline{SCC}$ signal is toggled to synchronously clock each flip flop of BCD counter 22. If the BCD counter safety check detects a divide by two failure in any of the flip flops of BCD counter 22, it will dud the fuze by disabling dud gate 60. A divide by two malfunction can cause an overhead safety failure by decreasing the time out for the fuze by a factor of 2. The allowable time interval (10 ms) for safety checking the divide by two operation of each flip flop in BDC counter 22 dictates the use of synchronous clocking. The limited time interval is a result of an auto set requirement to load BCD counter 22 with auto set requirement from processor 40 within 10 ms after setback. This timing is needed for data processor 40 to unload its valid word of nonvelocity data into BCD counter 22 so it can resume sampling the auto set data for a valid word of velocity data. The nonvelocity and velocity designators relate to the auto set data being corrected, by the muzzle exit velocity of the projectile. The normal, asynchronous mode of operation of BCD counter 22 simplifies the decoding of the clock for each succeeding flip flop of BCD counter 22. The clock is enabled by tying CL ENABLE high, ≧10 RESET INH low, and $\overline{SCC0}$ high. The asynchronous input and output for each stage of BCD counter 22 is CL and CL0, respectively.

The presettable feature of BCD counter 22 simplifies the external loading circuitry and timing. Loading each stage of BCD counter 22 with data from P1 through P4 merely requires a low input to gate 160 of that stage. The $\overline{LOAD}$ input to gate 160 provides the synchronous load of the safety check or auto set data and $\overline{A}$ through $\overline{D}$ input to gate 160 provides the asynchronous load of the hand set data.

An exclusive feature of BCD counter 22 is the use of inverter 170 to rollover the counter from "0" to "9" when BCD counter 22 is timing out the preselected time. The duration and phase relationship between inverter 170's output and the other signals in BCD counter 22 eliminate many logic gates and/or capacitors that woulde otherwise be needed to eliminate timing race conditions associated with typical BCD counters transitioning from a decimal count of "0" to a decimal count of "9".

Figure 12:
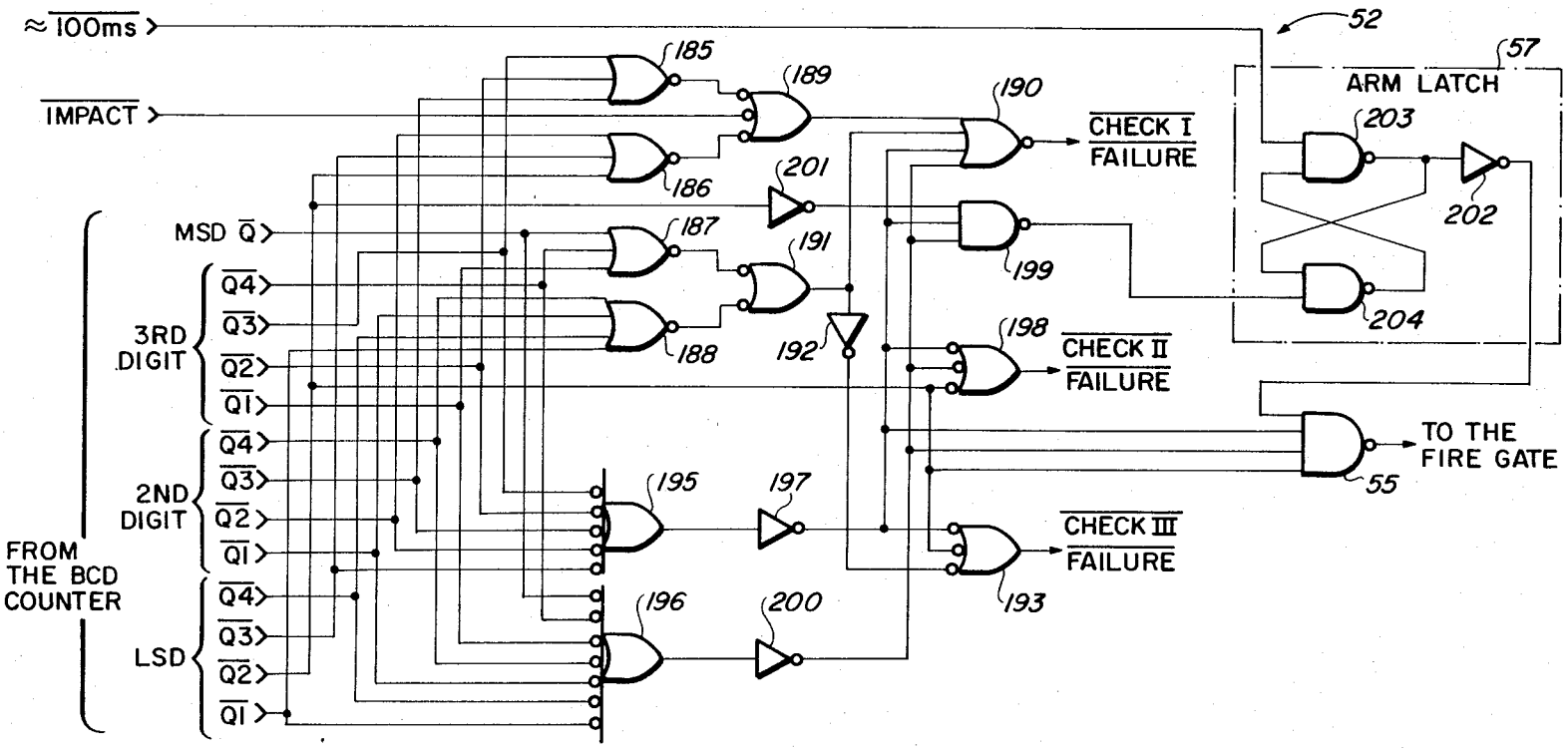
FIG. 12 is a schematic diagram of a BCD counter decode circuit incorporated in the fire command and overhead safety decode circuit of FIG. 1.

FIG. 12 schematically illustrates BCD counter decode circuit 52. Inputs to decode circuit 52 include 13 signals from BCD counter 22, an $\overline{IMPACT}$ signal from impact operation circuit 30 (FIG. 13) and ≈100 ms signal from loading sequencer 20. The 13 signals from counter 22 include four $\overline{Q}$ signals from the LSD stage, four $\overline{Q}$ signals from the second digit stage, four / signals from the third digit stage, and a $\overline{Q}$ signal from the MSD stage. A NOR gate 185 has a first input connected to receive the Q3 third digit signal, a second input connected to receive the Q2 third digit signal, and a third input connected to receive the Q3 second digit signal. A NOR gate 186 has a first input connected to receive the Q2 second digit signal, a second input connected to receive the Q3 LSD signal and a third input connected to receive the Q2 LSD signal. A NOR gate 187 has a first input connected to receive the $\overline{Q}$ MSD signal, a second input connected to receive the Q4 third digit signal and a third input connected to receive the Q1 third digit signal. A NOR gate 188 has a first input connected to receive the Q4 second digit signal, a second input connected to receive the Q1 second digit signal, a third input connected to receive the Q4 LSD signal, and a fourth input connected to receive the Q1 LSD signal. Thus, all 13 outputs from BCD counter 22 are connected to the 13 inputs of gates 185 through 188.

The output of gate 185 is connected to a first input of a NAND gate 189 and the output of gate 186 is connected to a second input of gate 189. A third input of gate 189 is connected to receive the $\overline{\text{IMPACT}}$ signal from impact operation circuit 30. The output of gate 189 is connected to a first input of a NOR gate 190, the output of which supplies a $\overline{\text{CHECK I FAILURE}}$ signal to the BCD counter safety check circuitry (FIG. 14). Outputs of gates 187 and 188 are connected to 2 inputs of a NAND gate 191, the output of which supplies a second input to NOR gate 190. The output of gate 191 is also connected through an inverter 192 to a first input of a NAND gate 193. Gate 193 supplies a $\overline{\text{CHECK III FAILURE}}$ signal to the BCD counter safety check circuitry.

A NAND gate 195 has 5 inputs connected to receive the $\overline{Q3}$ third digit signal, the $\overline{Q2}$ third digit signal, the $\overline{Q3}$ second digit signal, the $\overline{Q2}$ second digit signal and the $\overline{Q3}$ LSD signal, respectively. A NAND gate 196 has 7 inputs connected to receive the $\overline{Q}$ MSD signal, the $\overline{Q4}$ third digit signal, the $\overline{Q1}$ third digit signal, the $\overline{Q4}$ second digit signal, the $\overline{Q1}$ second digit signal, the $\overline{Q4}$ LSD signal, and the $\overline{Q1}$ LSD signal, respectively. The output of gate 195 is connected through an inverter 197 to an input of gate 190, an input of gate 193, and an input of a NAND gate 198. The gate 198 supplies a $\overline{\text{CHECK II FAILURE}}$ signal to the BCD counter safety check circuitry. The output from inverter 197 is also supplied to a NAND gate 199 and to arm gate 55, which is a NAND gate. The output of gate 196 is connected through an inverter 200 to an input of each of gates 55, 190, 198, and 199. In addition, the signal $\overline{Q2}$ from the LSD stage of counter 22 is connected through an inverter 201 to an input of gate 199. Also, the $\overline{Q2}$ signal from the LSD stage is connected to an input of each of gates 55, 193, and 198. The output of gate 199 is supplied to arm latch circuit 57 which includes a pair of NAND gates 203 and 204 connected as a flip flop with the output of gate 203 being connected through an inverter 202 to an input of gate 55. The output of gate 199 is connected to an input of gate 204 and the $\overline{\approx 100\ \text{ms}}$ signal is connected to an input of gate 203.

Arm gate 55 is enable when BCD counter 22 decrements to 000.0 seconds. The $\overline{\text{CHECK I FAILURE}}$, $\overline{\text{CHECK II FAILURE}}$, and $\overline{\text{CHECK III FAILURE}}$ outputs protect the fuze against an early function which might otherwise be caused by a preload of BCD counter 22 with 000.,0 or 000.1 seconds. This is accomplished with the aid of arm latch 57 which stores the detection of BCD counter 22 decrementing through 000.2 seconds. The fire command logic by itself utilizes gates 195, 196 and inverters 197, 200. The decode logic permits the sampling of the output of BCD counter 22 for 4 different times: 000.0, 000.2, 199.9, and 1FF.F (hexidecimal) seconds. 000.0 seconds is decoded by the fire command logic for identifying the fuze detonation time and, by the logic combination of the fire command and BCD counter safety check in gate 198 for verifying the divide by two operation of each flip flop in BCD counter 22. The overhead safety logic samples for the 000.2 second output and the AND function from gate 199 and subsequently stores this detection in arm latch 57. Not only does arm latch 57 store the detection of 000.2 seconds, it disables arm gate 55 until the completion of the BCD counter safety check and the loading of the selected set time into BCD counter 22. The 199.9 second output is verified by the BCD counter safety check logic with an OR function in gate 193. This safety check protects the timer logic from a failure of loading sequencer 20 to provide an output ($\overline{A}$ through $\overline{D}$) for programming BCD counter 22 with hand set data. Also, gate 190 detects the occurrence of 1FF.F (hexidecimal) to guarantee every flip flop in BCD counter 22 can be set with hand set data through manual decoder 23 and data selector 25.

As mentioned previously, the most significant digits in manual encoder 27 permits selection of impact operation for the fuze as well as selection for the most significant time digit. Manual programming for impact operation requires the encoder be set at Δ99.9, where Δ signifies an impact operation. The 99.9 encoder setting in addition to the delta symbol is used in consideration of the fuzes overhead safety requirement. The Δ99.9 encoder setting satisfies the fuzes 199.9 second impact operation safety check, which duds the fuze by disabling dud gate 60 if BCD counter 22 is not loaded with 199.9 from the setting code for impact operation. The impact selection is verified through the use of gate 189. The $\overline{\text{IMPACT}}$ signal is generated by impact latch 17 (see FIGS. 2 and 13). The impact operation needs verification since it enables impact gate 45 to sample the output of impact switch 47. In this operational mode, the functioning of the fuze does not provide the degree of overhead safety available in a time mode of operation due to the subjection of its detonator output to the spontaneous closure of impact switch 47.

The initiation of the detonator in the present fuze is controlled by the gates 55, 50, and 60 (illustrated in FIG. 1). Dud gate 60 is a NAND gate and prevents detonator initiation in case of a safety check failure by isolating the output of fire gate 50 from the detonator SCR. This isolation protects the fuze against an overhead safety failure as determined by the BCD counter safety check and stored in safety check latch 67. Fire gate 50 is a NAND gate that performs an OR function, permitting the fuze to be operated in either of two modes, impact or time. The impact operation input is provided by impact gate 45, which is a NAND gate. The time operation input is provided by arm gate 55, which enable fire gate 50 upon the detection of the unique signature of arm latch 57 being set and BCD counter 22 containing 000.0 seconds. The set condition of arm latch 57 indicates that BCD counter 22 has decremented through 000.2 seconds, thereby safeguarding the fuze against BCD counter 22 being initially loaded with 000.0 or 000.1 seconds.

As stated above, the present embodiment is capable of being programmed for either time or impact operation. When programmed for impact operation, the fuze will function upon closure of impact switch 47 at any time after 200 ms following launch. It is therefore important to check the circuitry dedicated to impact operation for safety critical failures. The impact operation is performed by the circuitry illustrated in FIG. 13. The impact sequence is initiated by selection of the correct code for impact in manual encoder 27 or in auto set data, from data processor 40. This is followed, in turn, by the loading of 199.9 seconds into BCD counter 22 which is sensed by the circuitry of FIG. 13 as follows. A NAND gate 205 receives a signal from the D output (MSD FIG. 7) of loading sequencer 20, and the second and third bit outputs from decoder 33 (FIG. 9). A second NAND gate 206 receives a LOAD II signal, an IMPACT bit signal and an LSB signal from data processor 40. The outputs of both gates 205 and 206 are supplied to 2 inputs of a NAND gate 207 which forms one-half of a flip flop circuit. A second NAND gate 208 forms the second half of the flip flop circuit and has an input connected to receive an inverted power on rest ($\overline{POR}$) signal. An output from gate 207 is applied to an input of impact gate 45. An output of gate 208 is applied as the $\overline{impact}$ signal to BCD counter decode circuit 52 (FIG. 12).

The gate 206 is essentially an auto set enable gate which requires simultaneous high levels on all three of the inputs to indicate that a valid impact command of auto set data is in the system. The LOAD II signal is generated by data processor 40 upon the occurrence of a valid word of auto set data. The IMPACT BIT and LSB signals are obtained from the valid word of auto set data stored in a shift register of data processor 40. Also contained within the valid word of auto set data are 13 bits which represent the selected set time for the fuze. Of these bits, the least significant bit is used directly to provide the LSB output. "AND"ing the LSB signal with other signals in gate 206 safeguards the fuze against a false indication of an impact operation mode. This indication can result from the first stage of the shift register in data processor 40 failing with its output always low. The selection of the impact operation is governed by the auto set data with a backup system using hand set data, as already described. The auto set function overrides the hand set backup by disabling loading sequencer 20 with the $\overline{TERM}$ signal. Disabling loading sequencer 20 prevents the occurrence of a high level for the D signal therefrom and continuously inhibits the impact operational mode in hand set data from setting flip flop 207–208 by way of gate 205.

The load enable signals from stages 2 and 3 of the BCD counter (LE2 and LE3) are applied to 2 inputs of a NOR gate 210. The CL ENABLE signal is applied through an inverter 211 to one input of a NOR gate 212 and directly to one input of a NAND gate 213, the output of which is connected to a third input of gate 210. The ≧RESET INH signal is applied directly to 1 input of gate 212 and to a fourth input of gate 210. An inverted safety check clock signal ($\overline{SCC}$) is applied to a third input of gate 212 and to a second input of gate 213. The output of gate 212 is supplied through an inverter 214 to a first input of a NAND gate 215. Safety check enable signal (SCE) is supplied to a second input of gate 215. The output of gate 215 is a $\overline{<100\ ms}$ SAFETY CHECK signal which is supplied to the BCD counter safety check circuitry (FIG. 14). A NAND gate 217 has 5 inputs connected to Q7 through Q11 of scaler 11 and a sixth input connected through an inverter 218 to the Q2 output of a two-stage impact counter 220. The output of gate 217 is connected to a third input of gate 215 and through an inverter 221 to the clock input of counter 220. The output from inverter 221 is also connected to a first input of a NOR gate 223. The Q2 output of counter 220 is connected to an input of impact gate 45. The Q1 and Q2 outputs of counter 220 are connected to 2 inputs of a NOR gate 225, the output of which is connected to a second input of gate 223 and a fourth input of gate 215. An output of gate 210 is also connected to an input of gate 223. The output of gate 223 is a ≧100 ms SAFETY CHECK signal which is supplied to the BCD counter safety check circuitry.

Counter 220 supplies a 200 ms inhibit signal which is used to negate false outputs from impact switch 47 due to setback or projectile vibrations within the weapon's muzzle. This is accomplished by disabling impact gate 45 with the Q2 output of counter 220. After 200 ms, impact gate 45 is enable by the Q2 output of counter 220. This enabling of impact gate 45 must be continuous to guarantee a reliable function of the fuze in its impact mode of operation. The enable is made continuous by latching the Q2 output of counter 220 with feedback through inverter 218 which disables gate 217 and the clock input to counter 220. The Q2 output of counter 220 is also connected to gate 42 (see FIG. 1) which disables the clocking of the BCD counter after 200 ms by continuously resetting scaler 11. The time duration for the 200 ms delay is actually 193.75 ms after setback, as determined by counter 220 and its clock gate 217. The value for the delay was chosen as a means of permitting a dual utilization of counter 220. Besides supplying the inhibit signal for impact gate 45, counter 220 is used for safety checking the control lines to BCD counter 22. These lines are used by the BCD counter safety check to verify the failsafe operation of the timer logic. Both direct and indirect monitoring of the control lines of BCD counter 22 are performed with the two 100 ms SAFETY CHECK signals. This safety check directly verifies the proper levels of the $\overline{SCC}$, CL ENABLE and ≧10 RESET INH signals. Indirectly, with feedback from the LE2 and LE3 signals, the described circuitry determines the proper functioning of the $\overline{B}$ and $\overline{C}$ signals from loading sequencer 20, the $\overline{LOAD\ I}$ signal from BCD counter safety check circuitry, and the LOAD II signal from data processor 40.

The BCD counter safety check circuitry incorporated in the present system is utilized to provide a minimum of early functioning fuzes and to minimize the amount of logic in the system. The circuitry contains failsafe configurations and independent, dedicated gating for inhibiting the fuze output with the detection of a safety critical failure. The present design satisfies the fuze requirement with a single operational system and additional circuitry as required to verify the failsafe operation of the logic. This alternate design produces a system with a minimum gate count, decreasing the size of the LSI chip containing the circuitry and increasing the reliability of the fuze. The philosophy of operation for the present system involves simulating a normal operation and verifying the safe performance of the logic. This simulation and verification is performed for the system logic by the BCD counter safety check circuitry illustrated in FIG. 14. The safety check circuitry simulates the normal operation of sampling and storing hand set data with decoder 33, loading the hand set data into BCD counter 22, decrementing the programmed set time in BCD counter 22, and decoding the fire command output from BCD counter 22. With the simulation of normal operation, verification of the safe performance of the logic can be accomplished by a single decode at the output of BCD counter 22. This decode will safety check decoder 33, the manual portion of data selector 25, the loading of BCD counter 22, the divide by two operation of BCD counter 22, and the fire command circuitry.

Referring specifically to FIG. 14, an MDLR signal generator includes 3 NAND gates 230, 231, and 232. Gate 230 is connected to receive the Q2, $\overline{Q3}$, and $\overline{Q4}$ signals from scaler 11 and provides a $\overline{\text{RESET 1}}$ signal to the first input of gate 232. In addition, an $\overline{\text{SCE}}$ signal is applied to a fourth input thereof from the $\overline{Q}$ output of a flip flop 233. Flip flop 233 is composed of a pair of interconnected NAND gates one side of which receives an input from a NAND gate 234 and the other side of which receives an inverted power on reset signal ($\overline{\text{POR}}$). The gate 234 is connected to the Q5 and Q6 outputs of scaler 11. The Q output of flip flop 233 is the SCE signal output to all previously described circuitry and is also applied to one input of a NOR gate 235. A second input of gate 235 is connected to the Q6 output of scaler 11 and the output of gate 235 is the $\geqq 10$ RESET INH signal applied to circuitry previously described. Gate 231 has 4 inputs connected to the Q6 through Q9 outputs of scaler 11 and a fifth input connected to receive the $\approx$100 ms signal available at the output of gate 116 of sequencer 20 (see FIG. 7). The output of gate 231 is a $\overline{\text{RESET 2}}$ signal that is applied to the second input of gate 232. The third input of gate 232 is the $\approx$100 ms signal and the output of gate 232 is the MDLR signal supplied to sequencer 20 and decoder 33, previously described.

A CHECK I verification circuit includes a NAND gate 236 and a NOR gate 237. Gate 236 has 4 inputs connected to receive the Q3, Q4, and $\overline{Q6}$ signals from scaler 11 and the $\overline{\text{SCE}}$ signal from flip flop 233. The output of gate 236 is applied to one input of gate 237 along with the $\overline{\text{CHECK I FAILURE}}$ signal from gate 190 of BCD counter decode circuit 52 (FIG. 12). The output of gate 237 is the CHECK I verification signal. The $\overline{\text{CHECK II}}$ and $\overline{\text{CHECK III}}$ verification circuits include three NAND gates 238, 239, and 240 and two NOR gates 241 and 242. Gate 238 has an input connected to receive the Q3 output from scaler 11 and the $\overline{\text{SCE}}$ signal from flip flop 233. The output of gate 238 is applied to an input of each of the gates 241 and 242. A second input to gate 241 is the Q4 output from scaler 11 and a second input to gate 242 is the $\overline{Q4}$ output from scaler 11. The output of gate 241 is applied to the first input of gate 239, a second input of which is connected to receive the Q5 output of scaler 11, and a third input of which is connected to receive the $\overline{\text{CHECK II FAILURE}}$ signal from gate 198 of BCD counter decode circuit 52. the output of gate 242 is connected to the first input of gate 240, a second input of which is connected to receive the Q6 output from scaler 11 and a third input of which is connected to receive the $\overline{\text{CHECK III FAILURE}}$ signal from gate 193 of BCD counter decode circuit 52. The output of gate 239 is the $\overline{\text{CHECK II}}$ verification signal and the output of gate 240 is the $\overline{\text{CHECK III}}$ verification signal.

A NAND gate 243 has four inputs connected to scaler 11 to receive the outputs Q2, Q3, $\overline{Q4}$, and $Q6_i$, respectively. A fifth input to gate 243 is connected to receive the $\overline{\text{SCE}}$ signal from flip flop 233. The output of gate 243 is the $\overline{\text{RESET I}}$ signal. A NAND gate 245 has 3 inputs connected to the scaler 11 to receive $\overline{Q3_i}$, Q4, and $\overline{Q5}$ signals therefrom. A fourth input to gate 245 is connected to receive the $\overline{\text{SCE}}$ signal from flip flop 233. The output of gate 245 is the $\overline{\text{LOAD I}}$ signal and is connected to the first input of NAND gate 381. The second input of gate 381 is connected to the $\overline{\text{LOAD II}}$ signal of data processor 40 and the output of gate 381 is connected to the input of inverter 382. The output of inverter 382 is the $\overline{\text{LOAD}}$ signal that is connected to each stage of BCD counter 22. A NAND gate 246 is connected to receive the $\overline{Q5_i}$ and Q6 output signals from scaler 11. The output of gate 246 is connected to a first input of a NAND gate 247, a second input of which is connected to receive the $\overline{\text{SCE}}$ signal from flip flop 233. The output of gate 247 is the CL ENABLE signal supplied to impact operation circuitry 30 (FIG. 13) and BCD counter 22 (FIG. 11). The CL ENABLE signal is also supplied through an inverter 248 to 1 input of a NAND gate 249. A NAND gate 250 has 2 inputs connected to receive the $\overline{Q3_i}$ and Q5 signals from scaler 11. The output of gate 250 is applied to a second input of gate 249 and a third input is connected to receive the $\overline{Q6_i}$ signal from scaler 11. The output of gate 249 is the SCC signal supplied to loading sequencer 20.

The safety check circuitry illustrated in FIG. 14 performs the function of programming decoder 33 with the $\overline{\text{RESET I}}$ and MDLR signals. The $\overline{\text{RESET I}}$ signal programs the output of decoder 33 to an "F" in hexidecimal by setting every manual data latch and their respective decimal-to-BCD decoders to a high level. The no contact detector 35 is also set by the $\overline{\text{RESET I}}$ signal because it masks the output of the LSB and MSB signals from the manual data latches when it is reset.

The CHECK I signal at the output of gate 237 validates the setting of every flip flop in BCD counter 22 with the $\overline{\text{LOAD I}}$ signal from gate 245 and the "F" output from decoder 33. The "F" output is routed to BCD counter through the manual portion of data selector 25. The CHECK I signal from gate 237 also confirms the safe operation of the fire command decoding circuitry, as will be explained presently. The MDLR signal creates a "9" output from decoder 33, as explained previously. This in turn causes counter 22 to be set to 199.9 when $\overline{\text{LOAD I}}$ occurs. The output of decoder 33 is programmed to a "9" by resetting the manual data latches therein and no contact detector 35 by way of the MDLR input. This reset causes the outputs of the manual data latches to go to a low state which causes the second digit and third digit outputs to go low. The enable gates 147 and 148 (FIG. 9) force the MSB and LSB outputs to high states as a result of the no contact detector 35 being reset by the MDLR signal. The 199.9 output from BCD counter 22 is verified by the $\overline{\text{CHECK III}}$ signal from gate 240. The verification confirms the safe operation of no contact detector 35 and safeguards the fuze from an output of loading sequencer 20 failing in a high state. Such a failure would prevent BCD counter 22 from being loaded with the digit of hand set data corresponding to the defective output of sequencer 20. Confirmation of the LSD signal of hand set data is not required since it can only change the programmed set time by a maximum of 0.9 seconds.

The synchronous clocking of BCD counter 22 permits the divide by two operation of counter 22 to be validated by the $\overline{\text{CHECK II}}$ signal from gate 239. The validation by the $\overline{\text{CHECK II}}$ signal is accomplished with the SCC signal while disabling the asynchronous clock of BCD counter 22 with the CL ENABLE and ≧10 RESET INH signals. The SCE signal which enables the BCD counter safety check is provided by flip flop 233.

Figure 13:
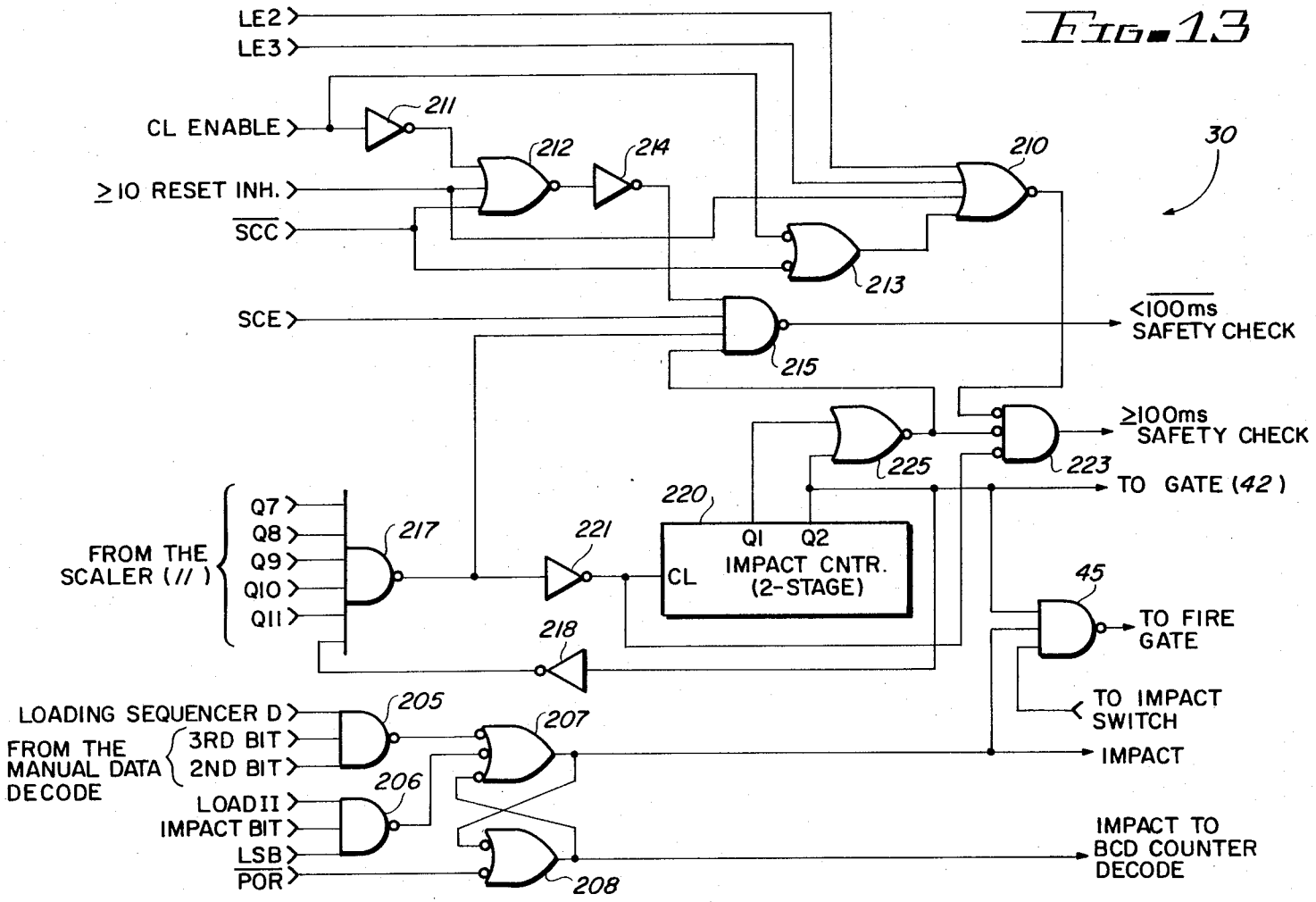
FIG. 13 is a schematic diagram of the impact operation circuitry from FIG. 1.

The CHECK I signal from gate 237 is applied to an input of a NOR gate 251. A REMOTE SELECTOR SAFETY CHECK signal is applied to a second input of gate 251. The REMOTE SELECTOR SAFETY CHECK signal is provided by comparing the 8 most significant bits from a 17 bit shift register in data processor 40 to the 8 most significant bits in the output of BCD counter 22. This comparison is performed with 12 gates (not shown). No comparison is performed on the 5 least significant bits of the set time since these bits cannot decrease the time by more than 4 seconds. The ≧100 ms SAFETY CHECK signal from gate 223 (FIG. 13) is applied to a third input of gate 251. The $\overline{\text{CHECK II}}$ and $\overline{\text{CHECK III}}$ signals from gates 239 and 240 are applied to 2 inputs of a NAND gate 252. The $\overline{<100\ \text{ms}}$ $\overline{\text{SAFETY CHECK}}$ signal from gate 215 (FIG. 13) is applied to a third input of gate 252. The $\overline{\text{CHECK III}}$ $\overline{\text{FAILURE}}$ signal is applied to one input of a NAND gate 253. A NOR gate 254 is connected to receive a $\overline{\text{Q11}}$ signal from scaler 11 on one input thereof and the $\overline{\approx 100\ \text{ms}}$ signal from gate 115 of loading sequencer 20 (FIG. 7) on a second input thereof. The output of gate 254 is supplied to an input of gate 253. A third input of gate 253 is connected to receive the IMPACT signal from gate 207 in impact operation circuitry 30 (FIG. 13). The output of gate 253 is connected to an input of a NAND gate 255. A $\overline{\text{DATA READY CHECK}}$ signal and a $\overline{\text{DATA READY CNTR CHECK}}$ signal are applied to 2 additional inputs of gate 255. The outputs of gates 252 and 255 are applied to 2 inputs of a NOR gate 256. A third input to gate 256 is connected to the POR safety check circuit 70. The circuit consists of a resistor R connected from the input to ground and a capacitor C connected from the input to terminal $V_{DD}$. The output of gate 256 is connected to one input of the gate 72, the output of gate 251 is connected to a second input of gate 72 and a $\overline{\text{SAMPLE SAFETY CHECK}}$ signal from data processor 40 is connected to a third input of gate 72. The output of gate 72 is connected to one input of safety check latch 67 with the other input having a POR signal applied thereto. The output of safety check latch 67 is applied to an inut of the dud gate 60 (see FIG. 1). Safety check latch 67 is formed by interconnecting two NOR gates.

Upon the detection of a safety critical failure by the safety check circuitry of FIG. 14, dud gate 60 is disabled by safety check latch 67. Disabling dud gate 60 duds the fuze by isolating the output of fire gate 50 from the detonator SCR. In addition to storing the outputs from CHECK I, $\overline{\text{CHECK II}}$, and $\overline{\text{CHECK III}}$, safety check latch 67 verifies the occurrence of power on reset (POR) and stores the detection of other safety failures discussed previously. The occurrence of POR is confirmed by sampling the outputs of POR and POR check circuit 70 with the safety check latch 67. This action permits latch 67 to be set with POR check circuit 70 upon the absence of POR and reset with the output of a valid POR pulse. The POR safety check pulse from circuit 70 will set safety chck latch 67 if its width exceeds the POR pulse width. Under normal conditions, the POR pulse width (RC) is twice the POR safety check pulse width. Proper operation of the BCD counter safety check circuitry and loading sequencer 20 requires the proper initialization of the scaler output with POR.

Referring to FIG. 15, data processor 40 is illustrated schematically. Data procesor 40 contains a pulse width discriminator 260, a 17 bit shift register 261, a data ready counter 262, an error bit detector 263, and operational mode control circuits for processing the auto set information. The auto set data transmitted to the fuze is received in receiver 37 and supplied to pulse width discriminator 260 at a remote data input terminal. The remote data input terminal is connected to one input of a NAND gate 265 and to one input of a NOR gate 266 which forms a portion of a data bit reset circuit. Gate 265 is an enable gate which governs the sampling of the remote data. The remote data input is also connected to a noise latch 267, which is formed from a pair of interconnected NAND gates and has a single output connected to the D input of the 17 bit shift register 261. The output of gate 265 is connected to the inverted clocking input of an enable latch 268. A D input of latch 268 is connected to the terminal $V_{DD}$, a reset input is connected to the output of gate 266, and an inverted reset input is connected to the output of a NOR gate 269. Gate 269 has a first input connected to receive the POR signal and a second input connected through an inverter 270 to an NAND gate 271. Components 269, 270 and 271 form a word sync reset circuit. A second input of gate 266 is connected to the output of a NAND gate 272 which has one input connected to the output of a NOR gate 273 and a second input connected to the Q output of latch 268. Components 266, 272, and 273 form the data bit reset circuit. The Q output of latch 268 is also connected to the second input of noise latch 267 and to the gate input of a gated RC oscillator 275. RC oscillator 275 includes a NAND gate 276, one input of which is the gate input and the output of which is connected through an inverter 277, a capacitor C, and a resistor R1 to the second input thereof. A resistor R2 is connected in parallel with inverter 277 and capacitor C. The timing components R1, R2 and C of oscillator 275 are external to the custom LSI to permit laser trimming to achieve the desired oscillator period. The output of oscillator 275 (also the output of gate 276) is conected to the inverted clock input of a first flip flop stage 280 in a three-stage down counter. The inverted clock input of the second stage 281 is connected to the $\overline{\text{Q1}}$ output of stage 280 and the inverted clock input of the third stage 282 is connected to the $\overline{\text{Q2}}$ output of stage 281. The Q output of latch 268 is connected through an inverter 283 to the reset inputs of each of the three stages 280, 281, and 282. The $\overline{\text{Q}}$ output of each stage is also feedback to its D input. The $Q1_i$ output of stage 280 is connected to a first input of gate 273, the $Q2_i$ output of stage 281 is conected to a second input of gate 273 and a first input of gate 271, and the Q3 output of stage 282 is connected to a second input of gate 271.

In addition to the above described circuitry, discriminator 260 includes set circuitry having two NOR gates 284 and 290, three NAND gates 285, 287 and 289, a NAND gate 286, an inverter 288 and a set latch 291. The Q3 output from stage 282 of the down counter is applied to a first input of gate 284. The Q3 output signal from stage 282 is applied to a first input of gate 287. A $Q3_i$ output of stage 282 is applied to a first input of gate 285, to a first input of gate 289, and to a first input of a latch 292 utilized to clock the 17 bit shift register 261. The $Q1_i$ output of the first stage 280 of the down counter is supplied to second inputs of gates 284, 287, and 289. The output of gate 284 is connected to a second input of gate 285, the output of which is connected to a first input of gate 286. A second input of gate 286 is connected to receive the $\overline{POR}$ signal. The output of gate 286 is connected to the set input of set latch 291. The output of gate 287 is connected through inverter 288 to the reset input of set latch 291. The D input of set latch 291 is connected to terminal $V_{DD}$. The output of gate 289 is connected to a first input of gate 290, the output of which is connected to the clocking input of set latch 291. a second input of gate 290 is connected to the output of error bit detector 263, which is an exclusive NOR gate. The Q output of set latch 291 is connected to an input of a reset latch 293 and to a first input of a NOR gate 295 which forms a first gate in the data ready counter 262.

The reset signal from inverter 283 in discriminator 280 is also connected to a second input of clocking latch 292, which is a latch formed by interconnecting two NOR gates. The output of latch 292 is supplied through the first input of NOR gate 296 to the clock input of 17 bit shift register 261. The output of clocking latch 292 is also supplied to the clock input of a first stage (300) of 4 stages of the data ready counter 262. The $\overline{CL}$ inputs of the remaining 3 stages 301 through 303 are connected to the Q outputs of the previous stage. A second input of reset latch 293, which is formed of 2 interconnected NOR gates, is connected to receive the POR signal. The output of latch 293 is connected to the reset input of the 17 bit shift register 261 and to a first input of a NOR gate 305 in the data ready counter. Q0 through Q16 outputs of 17 bit shift register 261 are connected to the remote data out terminals and are supplied therethrough to data selector 25. The Q0 output also provides the LSB signal to the FIG. 13 circuitry. The Q0 and Q16 outputs are connected to two inputs of the exclusive NOR gate forming the error bit detector 263 and to two inputs of a second exclusive NOR gate 306. The Q16 output is also connected to an input of a latch 307 formed from a pair of interconnected NOR gates. A second input of latch 307 is connected to the POR signal.

The output of exclusive NOR gate 306 is applied to a first input of a NOR gate 309. A second input of gate 309 is received from a NAND gate 310, the inputs of which are connected to the $Q1_i$ output of stage 280 in the down counter of discriminator 260 and the $Q3_i$ output of stage 282. The output of gate 309 supplies a clocking input to a safety check enable latch 312. An output of latch 307 is connected to a first input of a NAND gate 313, the output of which is connected to the set input of latch 312. A second input of gate 313 is connected to the output of a NAND gate 314, one input of which is connected to the output of a NOR gate 315 and the other input of which is connected to the $Q3_i$ output of stage 282 in discriminator 260. One input of gate 315 is connected to the Q3 output of stage 282 and the other input is connected to the $Q1_i$ output of stage 280 of discriminator 260. The D input of latch 312 is connected to terminal $V_{DD}$. The reset input of latch 312 is connected to a NOR gate 317, one input of which is connected to the output of a NAND gate 318 and the other input of which is connected to an inverter 319. One input of gate 318 is connected to the $\overline{Q3}$ output of stage 282 and the other input is connected to the $Q1_i$ output of stage 280 in discriminator 260. The Q output of latch 312 is connected to one input of a NAND gate 320, the output of which is connected to the output terminal bearing the $\overline{DATA\ READY\ CHECK}$ signal.

The output of latch 307 is also connected to a first input of a NAND gate 322, the other input of which is connected to the output of gate 295. The output of gate 322 is connected to a first input of a NAND gate 323 the other input of which is connected to the output of gate 305. A second input of gate 305 is connected to the output of a NOR gate 325. One input of gate 325 is connected to an output of a latch 326, which latch is formed of a pair of interconnected NOR gates, and a second input of which is connected to an output of latch 307. The output of latch 307 is also applied to a first input of a NOR gate 327, the output of which is applied to one input of the latch 327. The other input of latch 326 is connected to receive the POR signal. A second input of gate 326 is connected to the output of gate 322 in data read counter 262 and a third input is connected to the output of a NAND gate 330 in data ready counter 262. Gate 330 has four inputs connected to the four Q outputs of stages 300 through 303 of the upcounter. The output of gate 323 is connected to the set inputs of each of the stages 300 through 303 and to the set input of a divide by two flip flop 331. The output of gate 330 is connected to the inverted clock input of flip flop 331 and the $\overline{Q}$ output of flip flop 331 is connected to the second input of gate 296. The $\overline{Q}$ outputs of each of the four stages 300 through 303 are connected to the D input of the same stage and the $\overline{Q}$ outputs of the first three stages 300 through 302 are connected to the clock inputs of the last three stages 301 through 303, respectively. The output of gate 330 is connected to a first input of a NOR gate 332, a second input of which is connected to the Q output of flip flop 331. The output of gate 332 is connected to inverter 319 associated with safety check enable latch 312.

A latch 335, which includes a pair of interconnected NAND gates, has a first input connected to an output of latch 293. A second input of latch 335 is connected to an output of a NAND gate 336, one input of which is connected to the output of latch 307 and the other input of which is connected to the output of a NAND gate 337. One input of gate 337 is connected to the output of a NOR gate 338 and the other input is connected to the output of NOR gate 339. The output of latch 335 is connected to the output terminal having a $\overline{DATA\ READY\ CNTR\ CHECK}$ signal. A first input of gate 338 is connected to an input of the data processor having the RE signal applied thereto from data selector 25 (FIG. 10). A second input of gate 338 is connected to the output of a latch 340, which is a latch formed by a pair of interconnected NOR gates. A first input of latch 340 is connected to the $\overline{Q}$ output of flip flop 331 and a second input is connected to receive the POR signal thereon. The output of latch 340 is also connected to the output terminal having the $\overline{REE/TERM}$ output signal thereon and to a first input of a NAND gate 341, the output of which is connected to the terminal having the $\overline{LOAD\ II}$ signal thereon and through inverter 342 to the terminal having the LOAD II signal thereon.

A first input of gate 339 is connected to the output of inverter 342 to receive the LOAD II signal thereon and a second input is connected to the output of a NAND gate 345. The output of gate 345 is connected to an output terminal having the $\overline{DATA\ READY}$ signal thereon. The output of gate 345 is also connected to a second input of gate 341, a first input of NAND gate 347 and a second input of the gate 295 in data ready counter 262. A first input of gate 345 connects to the Q output of flip flop 331 and a second input is connected to the output of a NAND gate 350. One input of the gate 350 is connected to the $\overline{Q}$ output of flip flop 331 and the other input is connected to the output of NAND date 351. A first input of gate 351 is connected to the Q14 output of 17 bit shift register 261 and the other input is connected to the output of a NAND gate 352. Gate 352 has 2 inputs which are connected to the Q12 and Q13 outputs of the 17 bit shift register 261. The Q13 output of shift register 261 is also connected to an output of data processor 40 having the IMPACT BIT signal thereon.

The $\overline{Q}$ output of flip flop 331 is also applied to the inverted clocking input of a latch 355. The D input of latch 355 is connected to terminal $V_{DD}$. The reset input of latch 355 is connected to receive the POR signal thereon. The Q output of latch 355 is connected to first inputs of a NAND gate 356 and a NOR gate 357. The output of gate 351 is connected through an inverter 358 to a second input of gate 356 and the $\overline{Q}$ output of flip flop 331 is connected to a third input of gate 356 and a second input of gate 357. The output of gate 356 is applied to an output terminal having the $\overline{\text{SAMPLE SAFETY CHECK}}$ output signal thereon. The output of gate 357 is connected to a first input of a NOR gate 360, a second input of which is connected to the output of gate 351 and the output of which is connected to the D input of flip flop 331.

A second input of gate 347 and a second input of a NOR gate 362 are each connected to an input terminal of data processor 40 connected to receive the $\overline{\text{SCE}}$ signal from flip flop 233 of the BCD counter safety check circuitry (FIG. 14). A second input of gate 362 is connected to receive the $\overline{\approx 100\ \text{ms}}$ signal from loading sequencer 20. The output of gate 347 is applied to a first input of a NAND gate 365, a second input of which is connected to the output of gate 350. The output of gate 365 is connected through an inverter 366 to an input of enable gate 265 in discriminator 260. The $\overline{\text{LOAD II}}$ signal is also applied to the reset input of a latch 370, the clock input of which is connected to the output of gate 330 in the upcounter of data ready counter 262. The D input of latch 370 is connected to terminal $V_{DD}$. The Q output of latch 370 is connected to a first input of a NOR gate 371, a second input of which is also connected to receive the $\overline{\text{LOAD II}}$ signal. The output of gate 371 is connected to a second input of gate 320, which provides the $\overline{\text{DATA READY CHECK}}$ signal output.

An input labeled Q10, connected to the Q10 output of scaler 11, is connected to an input of a latch 375 formed from a pair of interconnected NOR gates. A second input of latch 375 is connected to receive the POR signal thereon. The output of latch 375 is connected to a first input of a NOR gate 376 and a first input of a NAND gate 377. A second input of gate 376 is connected to receive the $\overline{\text{LOAD II}}$ signal thereon and a second input of gate 377 is connected to the output of gate 350. The output of gate 376 is connected to a first input of a NOR gate 378, the second input of which is connected to the Q output of latch 370. The output of gate 378 is connected to an output terminal of data processor 40 having the $\overline{\text{SAFETY EN}}$ signal thereon. The output of gate 377 is connected to a first input of a NOR gate 380, a second input of which is connected to receive the POR signal thereon. The output of gate 380 is connected to an output terminal of data processor 40 having the $\overline{\text{RCVR DISABLE}}$ signal thereon.

Figure 16:
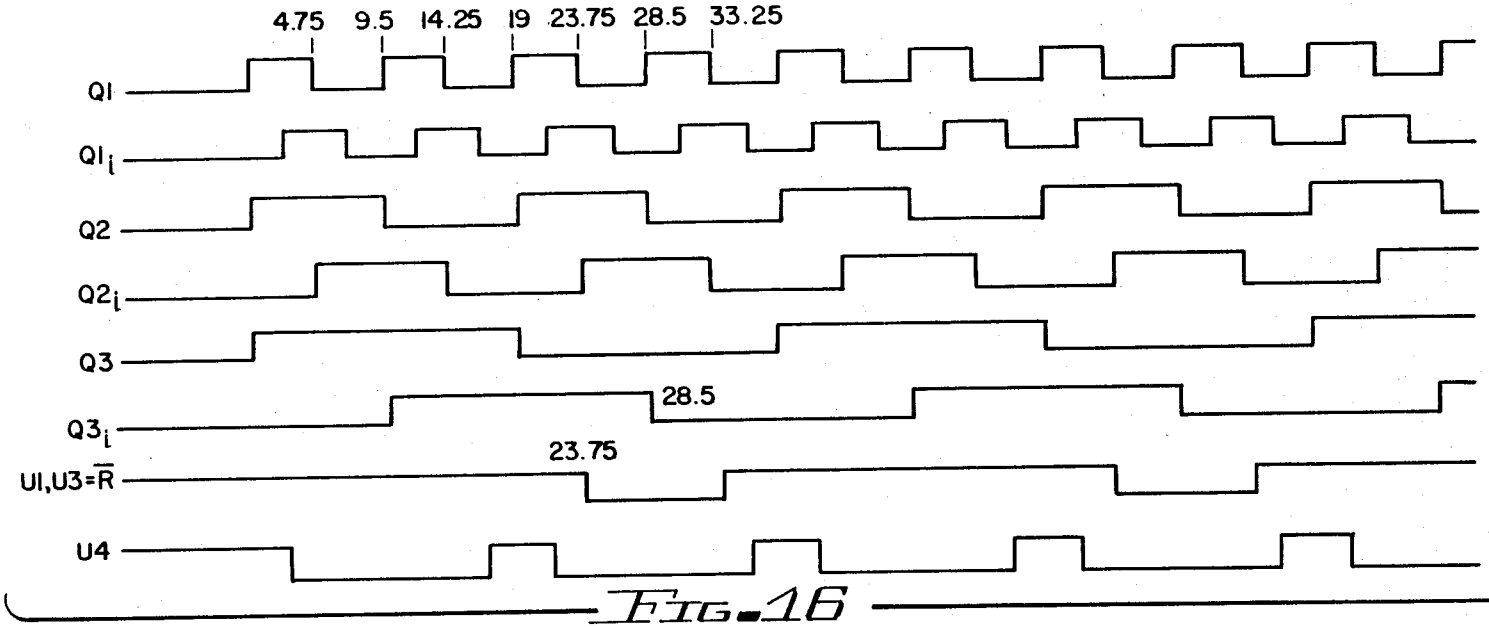
FIG. 16 illustrates a timing diagram for the discriminator portion of the data processor of FIG. 15.

The auto set data transmitted to the fuze is decoded by pulse width discriminator 260. Discriminator 260 separates each bit of remote data into a distinct type: word sync, binary one, or binary zero. The respective pulse widths are monimally 25, 15, and 5 ms, with a nominal bit period of 30 ms. The beginning of each word of remote data is identified by the word sync bit. The control information and set times for the fuze are conveyed by the binary zeros and ones. Each bit of incoming remote data is sampled by discriminator 260 through the triggering of noise latch 267 at the rising edge of the $Q3_i$ signal from stage 282 of the down counter, as shown by the timing diagram in FIG. 16. Being high when $Q3_i$ toggles high makes each word sync bit and 1 data bit be decoded as binary 1 bits of information. Being low when $Q3_i$ toggles high makes each 0 data bit be decoded as binary 0 information.

Sampling of the remote data is governed by enable gate 265 and the processor's operational mode control circuits. Enabled, gate 265 allows the pulse width discriminator 260 to decode the remote data. Disabled, gate 265 permits the proper operation of the BCD counter safety check and inhibits the sampling of remote data by data processor 260. Proper operation of the BCD counter safety check requires that the synchronous loading of valid remote data into BCD counter 22 be delayed until the check is completed. This delay permits the safety check to correctly manipulate and verify the output of BCD counter 22. By disabling gate 265, the operational mode control of data processor 40 discontinues the sampling of remote data. This disable permanently locks up the data in shift register 261 upon the reception of valid velocity or impact data. The lock up provides a reliable time duration for loading the valid velocity or impact data into BCD counter 22. It also conserves power by disabling RC oscillator 275.

Gate 265 is not disabled with the occurrence of valid non velocity data. This permits the sampling of remote data to resume after completion of the load of valid non velocity data into BCD counter 22. The resumed sampling allows the processor 40 to resume valid velocity data. Only with the recepiton of valid velocity or impact data will the sampling of the remote data be permanently inhibited at gate 265.

Figure 17:
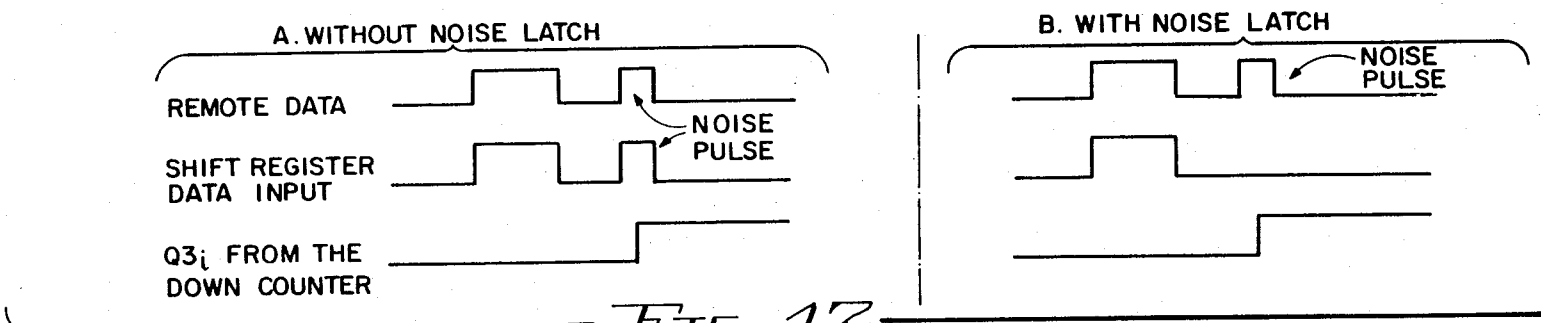
FIGS. 17A and 17B illustrate timing diagrams for the data processor of FIG. 15 without and with a noise latch, respectively.

Enable latch 268 allows pulse width discriminator 260 to decode the remote data, by enabling oscillator 275 to clock the down counter 280, 281, and 282. In turn, the down counter disables latch 268 with the data bit and word sync resets. These resets initialize enable latch 268 during power on reset and after each bit of remote data is sampled. They also enchance the probability for programming the fuze with remote data. The enhancement is achieved by preventing the down counter from sampling noise pulses, whose pulse widths are less than half of the period of oscillator 275. At the falling edge of each noise pulse, the sampling is prevented by gate 266 resetting enable latch 268. However, feedback is now needed from the output of enable latch 268 to the input of gate 272 to inhibit gate 266 during the remote data's rising edge. This allows enable latch 268 to be clocked when the incoming remote data transitions to a high state, initiating the decode sequence. The outputs of the down counter, which are decremented by RC oscillator 275, are used to decode each bit of remote data and to control the set circuitry. Each bit of remote data is stored in latch 267. Subsequent loading of this data into shift register 261 is accomplished by clocking register 261 with the rising edge of $Q3_i$ from stage 282 of the down counter. Noise latch 267 protects the system from invalid data due to noise in the form of short duration pulses. Operation of latch 267 can be explained with the timing diagram in FIG. 17, depecting a short noise pulse superimposed on a binary 0 bit of remote data. Without noise latch 267, the noise pulse would load a binary 1 into shift register 261 at the rising edge of $Q3_i$, as illustrated in FIG. 17A. However, latch 267 loads register 261 with the correct data by isolating the noise pulse from the data input of shift register 261. The isolation is achieved when the falling edge of remote data resets latch 267, as illustrated in FIG. 17B. Latch 267 is initialized (set) by enable latch 268 prior to sampling each bit of remote data.

The set circuitry of discriminator 260 governs the operation of data ready counter 262 during the sampling of the remote data by initializing (setting) counter 262 through the data counter set, upon the occurrence of power on reset, each word sync bit, and or each bit error. For an accurate detection of valid data this initialization is maintained until the end of each word sync bit or until the incoming remote data provides another word sync bit to data processor 40. Each sync bit will first set then reset set latch 291 of discriminator 260. The set and reset operations are provided respectively by set gates 284, 285, and 286 and disable gate 287 and inverter 288. When set, latch 291 will initialize data ready counter 262.

Bit error detection is accomplished with error bit detector 263 and sample gates 298, 290 of the set circuitry of discriminator 260. Sample gates 289 and 290 are needed to omit the transitions at the output of error bit detector 263 due to the normal delays in shift register 261. These delays occur during each clock input of shift register 261, due to the internal gate delays required to transfer each bit or remote data from one state of shift register 261 to the next. Error bit detector 263 determines the validity of the remote data by comparing each bit of incoming remote data (Q0 output of shift register 261) to the corresponding bit of remote data stored in the shift register (Q16 output of shift register 261) from the previous word. This comparison allows error bit detector 263 to recognize the occurrence of 2 sequential, identical words of remote data, which is the unique signature for valid data. Finally, the down counter of discriminator 260 enables independent logic (gates 310, 306, 309, 315, 314, 313, 318, and 317 and latch 312) for checking the failsafe operation of the set circuitry of discriminator 260. Also, the independent logic performs a synchronous safety check with its checking operation occurring during the normal operation of the set circuitry.

Shift register 261 checks data ready counter 262 and stores the incoming remote data. Storage of the remote data permits BCD counter 22 to be synchronously loaded with valid data from shift register 261 and provides data to error bit detector 263 for identifying the presence of two identical, sequential words of remote data. This identification safeguards the fuze from loading BCD counter 22 with invalid remote data. Of the 17 bits in shift register 261, 1 bit (Q 16) is needed by error detector 263 for comparing the incoming remote data (Q0) to the corresponding bit (Q16) of the stored data word, 16 additional bits are necessary to store a complete word of remote data. Of these, 1 bit provides storage for the word sync bit, 13 bits contain the BCD coded set time for the fuze, 1 bit supplies the velocity correction status of the data, and 1 bit determines the function mode for the fuze (time of impact).

Data stored in shift register 261 corresponds either to the information from the auto set input or the initial data programmed into shift register 261 for verifying the failsafe operation of data ready counter 262. Q0 of shift register 261 is the most significant bit and Q12 is the least significant bit. Operation mode control is achieved through flag bits within each word of remote data. These bits note the velocity status of the data and function mode for the fuze. The velocity status is obtained from bit Q14 of shift register 261. The auto set data is denoted as being either uncorrected or corrected for the projectile's muzzle exit velocity through Q14 being either a binary 1 or binary 0, respectively. The function mode for the fuze is obtained from Q13 of shift register 261. It denotes either impact or time operation for the fuze, respectively, corresponding to Q13 being a binary 0 or binary 1.

A safety check on data ready counter 262 confirms the failsafe operation thereof. This safety check is needed since data ready counter 262 provides the command for valid auto set data. With this command, the set time for the fuze becomes the information stored in shift register 261 and, if incorrect, the command could cause an overhead safety failure by loading BCD counter 22 with a short set time. The safe operation of data ready counter 262 is confirmed through an asynchronous operation, i.e., prior to not simultaneous with, the normal operation of data processor 40. The checking operation only functions during the 15 bits of auto set data following the first word synchronization bit. During this operation, a comparison is made between the outputs of shift register 261 and data ready counter 262. With the proper preload, shift register 261 acts as a counter thus allowing it to be used to check the operation of data ready counter 262 after both circuits have been clocked fifteen times. This check protects against any failure in data ready counter 262 which would permit an output therefrom prior to the occurrence of 15 bits of auto set data.

In order to utilize shift register 261 as a counter it has to be initialized correctly with a 1 at Q1 thereof and zeros at Q2 through Q16. The state of Q0 in shift register 261 is not established by the initialization requirements. This "don't care" condition for Q0 results from its occurrence after Q1, where the 1 bit from Q1 is clocked through shift register 261 and terminates the data ready counter safety check. In the present embodiment Q0 is initialized to a logic 1 state so that the preprogrammed set time in shift register 261 is 180.0 seconds rather than the 80.0 seconds set time which results if Q0 were initialized to a 0. Any early output from data ready counter 262 during the safety check will dud the fuze. the early output will be detected by gate 345 of the operational mode control logic. This detection will set latch 335 by way of gate 339. Latch 335 samples other safety outputs during the data ready counter safety check. These other outputs sampled are the RE, REE/$\overline{\text{TERM}}$, and LOAD II signals.

The asynchronous data ready counter safety check utilizes both functional logic and control gating. This approach decreases the specialized or additional circuitry needed to confirm the safe operation of counter 262. For this check, the specialized circuitry is limited to the control gating which includes latch 293 (check C latch), latch 307 (check D latch), gates 335 through 339 (check E latch), and gates 325 through 327 (check F latch). The functional logic includes discriminator 260 and shift register 261. Functionally, discriminator 260 decodes the incoming remote data for clocking shift register 261 and incrementing data ready counter 262. Recognition of the word sync bit is performed by the set circuitry of discriminator 260 which then begins the safety check by setting the check C latch. Finally, shift register 261 is used to stimulate a counter which generates a time window for checking the failsafe operation of data ready counter 262.

The manipulation of the functional logic by the control gating entails initializing shift register 261 with check C latch to a set time of 180.0 seconds. As a result, binary 0's are programmed into Q13 through Q16 of register 261. These stages, respectively, are the impact flag bit, velocity flag bit, word sync bit, and check bit. The check bit is used by error bit detector 263 for identifying non correlation between each bit of incoming auto set data and the corresponding bit of auto set data stored in shift register 261. Any non correlation indicates a bit error, which reinitializes the data ready counter 262 to sample the next word of remote data for a valid set time. by combining the logic levels at the outputs of shift register 261, Q0 and Q1 are initialized to binary 1's and Q2 through Q16 are initialized to binary 0's. This initialization begins with the power on reset circuit setting check C latch and is disabled with the first word sync bit from the incoming remote data. This bit, identified by discriminator 260 and the set circuitry therein, resets check C latch.

Subsequent manipulation of the functional logic by the control gating involves discriminator 260 clocking shift register 261 and incrementing data ready counter 262. During these operations, the output of data ready counter 262 is sampled by check E latch for an eary output while check F latch temporarily disables the set input of data counter 262. The disable permits the counter 262 to increment continuously, independent of error bit detections or the occurrence of word sync bits within the incoming remote data. This disable allows the full counting sequence to be verified by the data ready counter safety check. The counting sequence totals 15 increments, 1 for each bit of remote data deemed valid by error bit detector 263. Completion of the data ready counter safety check occurs after 15 bits of auto set data have been received following the first word synchronization bit. This operation entails setting check D latch with a logical 1 at Q16 of shift register 261. This logical 1 is sequentially shifted to the shift register during each of the 15 bits of auto set data progressing from Q1 to Q16. Once set, check D latch disables further sampling of data ready counter 262 with check E latch. Also, it enables check F latch to initialize data ready counter 262 to sample for valid data. Finally, the check concludes with check F latch being set after it verifies the proper initialization of data ready counter 262 with the output of gate 330.

A data ready safety check confirms the safe operation of error bit detector 263, the set circuitry of discriminator 260 and data counter set. This check is a synchronous operation which duplicates the operation of error bit detector 263 and the set circuitry simultaneous with the normal function of the circuitry it verifies. This duplication verifies the proper reinitialization of data ready counter 262 through the data counter set 295, 322, 305, and 323 by error bit detector 263 and set circuitry 284 through 291. The reinitialization sets the output of the upcounter, 300 through 303, to a 15 (1111 in hexadecimal) and the Q output of divide by two flip flop 331 to a logical 1. This reinitialization results from the detection of a bit error or the decoding of a word sync bit. The bit error is identified by detector 263 and the word sync bit is identified by the set circuitry 284–291. The word sync bit preceeds each word of auto set data and enables data ready counter 262 to resample the incoming data for a valid set time. The resampling is accomplished by removing the initialization input to data ready counter 262 from the set circuitry and data counter set. This initialization is only removed with the decoding of a word sync bit. Otherwise, it is continuously applied to data ready counter after power on reset or the detection of a bit error.

Duplicating the operations of error bit detector 263 and the set circuitry demands duplicate logic. This logic includes error bit detector 306 and set circuitry 310, 309, 315, 314, 313, 318, 319, 317, and 312. The reset to the duplicate set circuitry is applied by gate 317 through gate 319. It utilizes the output of the set check, gate 332, to verify the proper reinitialization of data ready counter 262. Sampling of the outputs of data counter safety check is performed by data ready check circuit 370, 371, and 320. This circuit inhibits the fuze output by disabling dud gate 60 when an erroneous indication of valid data is provided by the improper operation of error bit detector 263, set circuitry 284–291, or data counter set 295,322, 305, and 323. This sampling occurs prior to the programming of BCD counter 22 with the auto set data.

A remote selector safety check tests for the safe transfer of valid rmote data from shift register 261 in data processor 40 to BCD counter 22. The check protects against safety critical failures in the auto set portion of data selector 25 and manual remote control gate 156 (see FIG. 10). Enable gate 378 confirms the failsafe transfer of valid non velocity data prior to resampling the incoming bit for valid velocity data. Proper transfer is also confirmed if the data transfer was in progress when receiver 37 is disabled. Enable gate 378 is controleld by gate 376 and latch 370. A brief description of the sampling gates which provide the remote selector safety check was described previously. By sampling for outputs of BCD counter 22 that should be set by the outputs of shift register 261, the sampling gates verify the safe transfer of the data. The gates do not verify the resetting of any stage in BCD counter 22, since a decreased set time cannot result from the failure of any stage in the counter of reset. Also, the gates do not confirm the setting of the 5 least significant bits in the set time since these bits cannot decrease the programmed time by more than 4 seconds. The SAFETY EN signal from gate 378 of data processor 40 is applied to the input of an AND gate, along with the ORed output of the sampling gates to provide the REMOTE SELECTOR SAFETY CHECK signal applied to gate 251 (see FIG. 14).

Thus, a complete fuze is disclosed which greatly improves the overhead safety by including self checking logic circuitry. Because the self check logic greatly reduces the number of components utilized the entire described system can be included on a custom LSI chip. The self checking logic provides failsafe operation for the fuze which includes auto set, or remote setting of the fuze and backup hand setting capabilities. Also, the fuze operates in the impact or programmed set modes. A specific embodiment of the fuze is illustrated wherein specific logic circuits and times are described. However, it will be understood by those skilled in the art that changes in the specific logic or in the various times utilized are considered to be within the knowledge of those skilled in the art. We desire it to be understood, therefore, that this invention is not limited to the particular form shown and we intend in the appended claims to cover all modifications which do not depart from the spirit and scope of this invention.

What is claimed is:

1. Timing apparatus incorporated in a fuze comprising:

oscillator means for providing clock pulses including a multivibrator having an upper limit frequency of operation beyond which said multivibrator does not provide an output;

data selecting means for providing an output indicative of a preselected time;

a counter coupled to receive the clock pulses from said oscillator means and further coupled to said data selecting means for counting clock pulses until the preselected time is achieved;

firing means coupled to said counter for detonating the fuze after the preselected time is achieved; and checking means coupled to said counter and said firing means for performing safety checks on said counter and deactivating said firing means in the event of a failure.

2. Timing apparatus for a fuze comprising:

oscillator means for providing clock pulses;

data selecting means for providing an output indicative of a preselected time, said data selecting means including setting means for setting the preselected time one of manually at the fuze and automatically remote from the fuze;

a counter coupled to receive the clock pulses from said oscillator means and further coupled to said data selecting means for counting clock pulses until the preselected time is achieved;

firing means coupled to said counter for detonating the fuze after the preselected time is achieved, said firing means including logic circuitry connected to receive any one of an impact signal and a preselected time signal; and checking means coupled to said counter and said firing means for performing safety checks on said counter and deactivating said firing means in the event of a failure, said checking means including circuitry for receiving remote setting signals and verifying means coupled to said receiving circuitry for verifying the validity of received remote setting signals.

3. Timing apparatus as claimed in claim 2 wherein the verifying means includes a pulse width discriminator.

4. Timing apparatus as claimed in claim 3 herein the verifying means further includes a shift register and logic for identifying the presence of two identically sequential words of remote data.

5. Timing apparatus as claimed in claim 4 where the apparatus is included in a single large scale integrated circuit.

6. Timing apparatus incorporated in a fuze comprising:

oscillator means for providing clock pulses;

data selecting means for providing an output indicative of a preselected time;

a counter having a plurality of stages ranging from most to least significant, said counter being coupled to receive the clock pulses from said oscillator means and further coupled to said data selecting means for counting clock pulses until the preselected time is achieved;

firing means coupled to said counter for detonating the fuze after the preselected time is achieved;

checking means coupled to said counter, said data selecting means and said firing means for checking the operation of at least the most significant stages of said counter, for checking the operation of said data selecting means and for deactivating said firing means in the event of a failure in one of said counter and said data selecting means.

* * * * *